US005166019A

United States Patent [19]

Ueda et al.

[11] Patent Number: 5,166,019

[45] Date of Patent: Nov. 24, 1992

[54] PHOTOSENSITIVE MEMBER COMPRISING SPECIFIED DISTYRYL COMPOUND AS CHARGE TRANSPORTING MATERIAL

[75] Inventors: Hideaki Ueda, Kawanishi; Shigeaki Tokutake, Takatsuki; Keiichi Inagaki, Itami, all of Japan

[73] Assignee: Minolta Camera Kabushiki Kaisha, Osaka, Japan

[21] Appl. No.: 808,609

[22] Filed: Dec. 17, 1991

[30] Foreign Application Priority Data

Dec. 20, 1990 [JP] Japan ..... 2-404290
Dec. 27, 1990 [JP] Japan ..... 2-407916

[51] Int. Cl.[5] ..... G03G 5/06
[52] U.S. Cl. ..... 430/58; 430/70; 430/73
[58] Field of Search ..... 430/58, 70, 73

[56] References Cited

U.S. PATENT DOCUMENTS 3,820,989 6/1974 Rule et al. ..... 96/1.5
4,465,857 8/1984 Neumann et al. ..... 564/251
4,477,550 10/1984 Horie et al. ..... 430/59
4,606,988 8/1986 Sasaki ..... 430/59
4,777,296 10/1988 Sasaki ..... 430/70

FOREIGN PATENT DOCUMENTS 62-120346 6/1987 Japan .

*Primary Examiner*—John Goodrow
*Attorney, Agent, or Firm*—Burns, Doane, Swecker & Mathis

[57] ABSTRACT

The present invention relates to a photosensitive member comprising a specified distyryl compound as a charge transporting material. The specified distyryl compound may be used in combination with a specified silicone oil and a specified butyrated phenol.

16 Claims, 1 Drawing Sheet

PHOTOSENSITIVE MEMBER COMPRISING SPECIFIED DISTYRYL COMPOUND AS CHARGE TRANSPORTING MATERIAL

BACKGROUND OF THE INVENTION

The present invention relates to photosensitive members having a photosensitive layer containing distyryl compounds.

In electrophotography generally known are a direct process in which electrostatic charge and exposure are applied onto the surface of photosensitive layer of a photosensitive member to form an electrostatic latent image which is then visualized by development with a developer and the visual image is fixed directly as it is on the photosensitive member to obtain a copied image; the particle figure transfer process in which visual images on a photosensitive member are transferred to paper or other materials and the transferred images are fixed to obtain copied images; and a latent image transfer process in which electrostatic latent images on a photosensitive member are transferred onto transfer paper and the electrostatic latent images on the transfer paper are developed and fixed.

As the materials employed for the construction of the photosensitive layer of the photosensitive member in these types of electrophotographic process, selenium, cadmium sulfide, zinc oxide and other inorganic photoconductive substances are known.

While these photoconductive substances have many profitable features as, for example, they allow only little dissipation of charge in the dark and dissipate charge rapidly upon exposure of light, they have various disadvantages. For example, the selenium-type photosensitive members require difficult manufacturing conditions and high manufacturing costs and special care for handling because they are fragile to heat and mechanical impacts. The cadmium sulfide-type and zinc oxide-type photosensitive members are so defective that stable sensitivity is hardly obtained in humid environment and stable capacity over a long period cannot be expected because the pigment added as a sensitizer causes deterioration in electrostatic charge due to corona electrical charging and photodiscoloration due to exposure.

On the other hand, various organic photoconductive polymers including polyvinylcarbazole have been proposed but while these polymers are superior to the above inorganic materials in layer formation, light weight and other properties they are still inferior to the inorganic substances in regard to achieving sufficient sensitivity, durability and stability in changing environment.

In the case of organic photoconductive compounds with low molecular weights, it is profitable to be able to control the physical properties or electrophotographic characteristics of the coated layer by selecting the kind and composition ratio of the binder to be used together, but the combination of the organic photoconductive material with a binder resin requires high compatibility of the compounds with the binder.

The photosensitive members made by dispersing such organic photoconductive compounds of high or low molecular weight are defective in that they show high residual potential and low sensitivity due to much trapping of carrier. Therefore it has been proposed to formulate a charge-transporting material to the photoconductive compounds to overcome these defects.

Also the separated function-type photosensitive members have been proposed in which the charge-generating function and the charge-transporting function of the photoconductive function are divided to different substances. In such a type of photosensitive members, a number of organic compounds have been considered as the charge-transporting materials to be used in the charge-transporting layer, but they bring about many problems. For example, 2,5-bis(p-diphenylaminophenyl)1,3,4-oxadiazole which is reported in U.S. Pat. No. 3,189,447 has so low a compatibility with binders that it is readily crystallized out. The diarylalkane derivatives described in U.S. Pat. No. 3,820,989 have good compatibility with binders but show change in sensitivity when used repeatedly. The hydrazone derivatives described in Japanese Patent Laid-Open Publication No. 59143/1979 show relatively good characteristics of residual potential but have such shortcomings as poor capacity for electrostatic charge and repeatability.

Thus, it is concluded that few organic compounds of low molecular weight with practically satisfactory characteristics for making photosensitive members are known presently.

It should be noted that distyryl compounds were disclosed as the compounds with good charge-transporting ability in Japanese Patent Laid-Open Publications Sho-60 175052 and Sho-62 120346, but they are quite different in chemical structure from the compounds to be disclosed in the present application.

SUMMARY OF THE INVENTION

The object of the present invention is to provide such photosensitive members that contain distyryl compounds with excellent compatibility with binders and charge-transporting ability, show high sensitivity and electrifying ability, give little fatigue deterioration upon repeated usage and reveal stable electrophotographic characteristics.

Another object of the present invention is to provide such photosensitive members capable of preventing deterioration in their surface caused by oxidation by ozone and like, high in sensitivity and satisfactory in both repeatability characteristics and change with time.

Further object of the present invention is to provide photosensitive members that are produced by application of photoconductive coating solution with excellent stability and good coating efficiency.

DETAILED DESCRIPTION OF THE INVENTION

Figure 1:
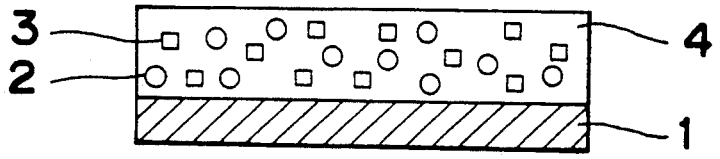
FIG. 1 shows a schematic sectional view of a photosensitive member wherein a photosensitive layer (4) is formed on a substrate (1).

The objects of the present invention can be achieved by using a specified distyryl compound as a charge transporting material.

A first aspect of the present invention relates to photosensitive members with a photosensitive layer containing distyryl compounds shown by the general formula [I] below formed on a substrate.

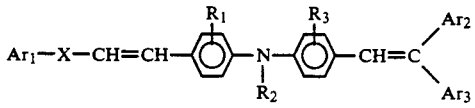

[I]

In the general formula [I], $Ar_1$ stands for such a lower alkyl group as methyl and ethyl, an aralkyl group such as benzyl or an aryl group such as phenyl and naphthyl, and these groups may contain such substituents as an alkyl group, an alkoxy group and a disubstituted amino group.

$Ar_2$ and $Ar_3$ represent respectively a hydrogen atom, a lower alkyl group such as methyl, an aralkyl group such as benzyl, an aryl group such as phenyl or a heterocyclic group such as thienyl, furyl or a residue of dioxaindane, and these groups may contain such substituted groups as alkyl, alkoxy, hydroxy, disubstituted amino and halogen.

$R_1$ and $R_3$ represent respectively a hydrogen atom, an alkyl group such as methyl, an alkoxy group such as methoxy and ethoxy or halogen atoms such as chlorine.

$R_2$ represents a alkyl group such as methyl, an aralkyl group such as benzyl or an aryl group such as phenyl, and these groups may contain substituents.

X stands for oxygen or sulfur atom.

The distyryl compounds represented by the general formula [I] in the first aspect of the present invention has a structural characteristic in that they are unsymmetrical with respect to the nitrogen atom, which contributes to giving such excellent characteristics to photosensitive members in compatibility with resins, sensitivity and repeatability properties.

As the preferred examples of the distyryl compounds represented by the general formula [I] of the present invention those with the following structures may be mentioned but they do not limit the scope of the invention.

[1]

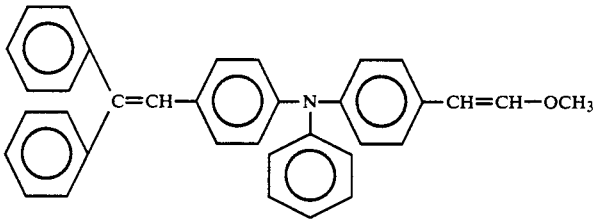

[2]

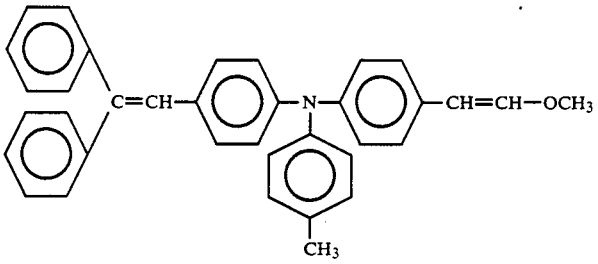

[3]

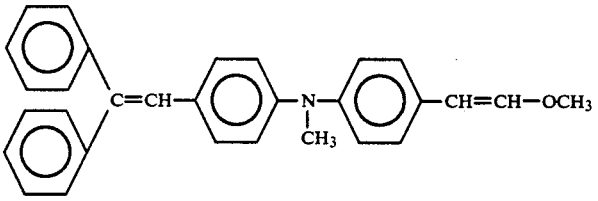

[4]

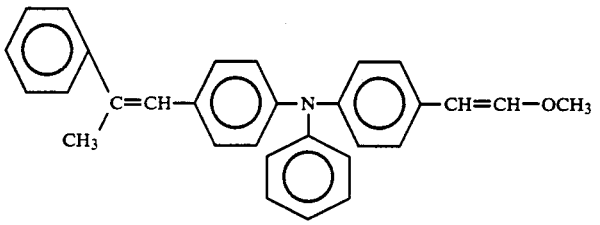

-continued
[5]
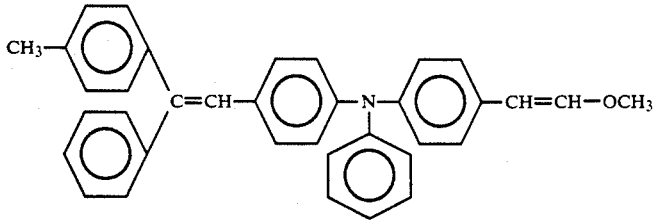
[6]
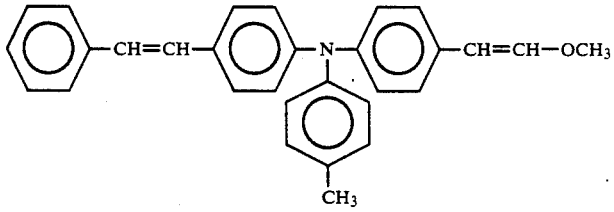
[7]
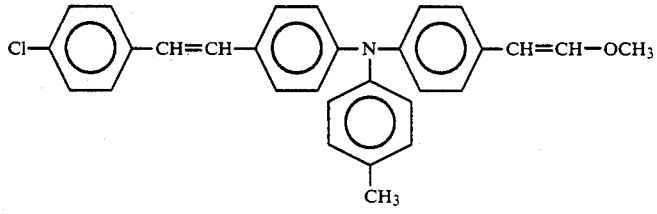
[8]
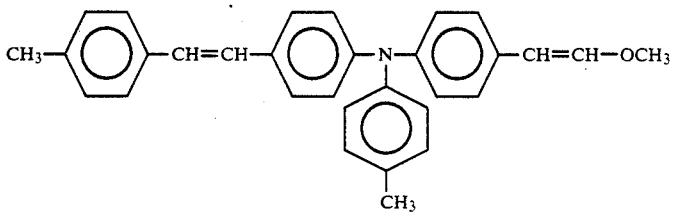
[9]
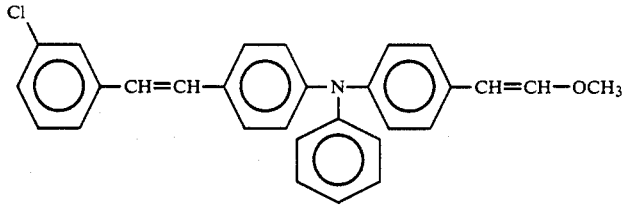
[10]
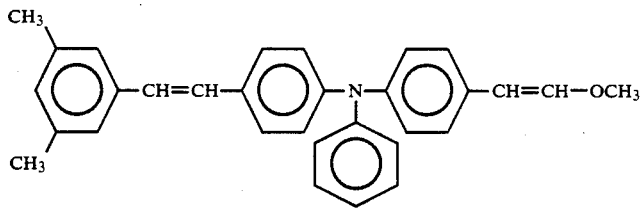
[11]
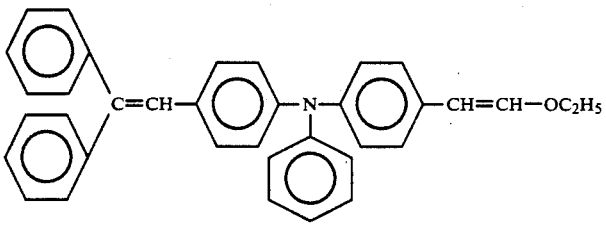

-continued
[12]
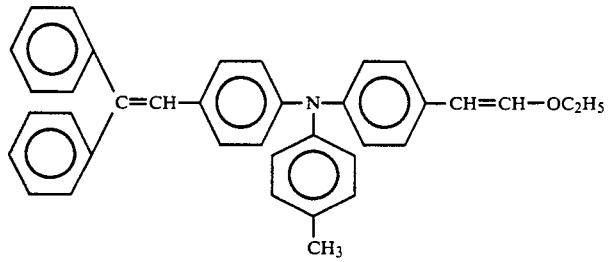
[13]
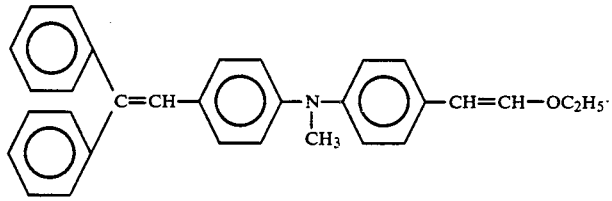
[14]
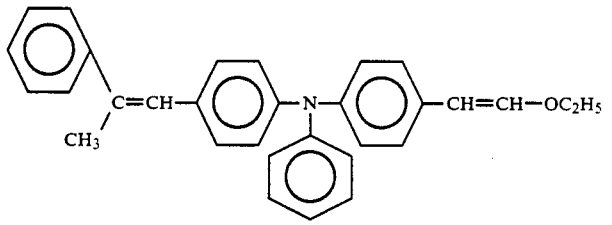
[15]
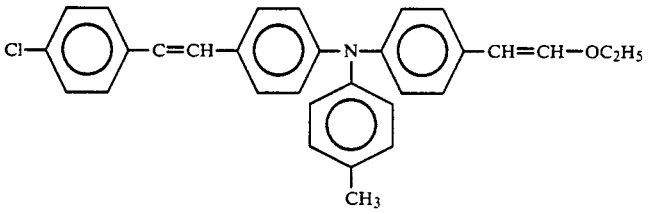
[16]
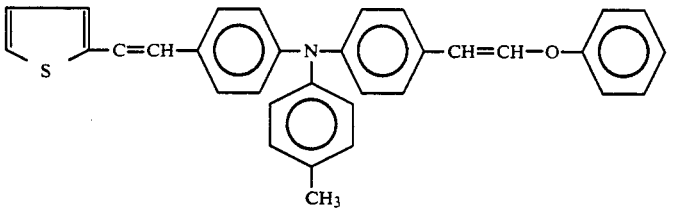
[17]
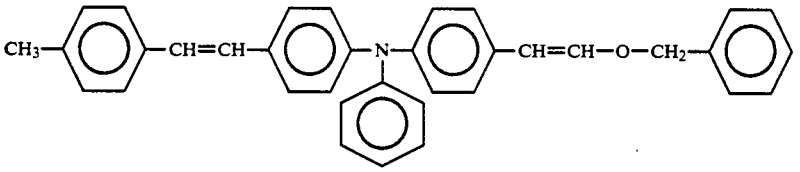
[18]
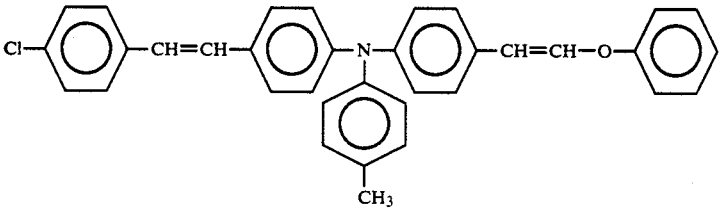

-continued
[19]
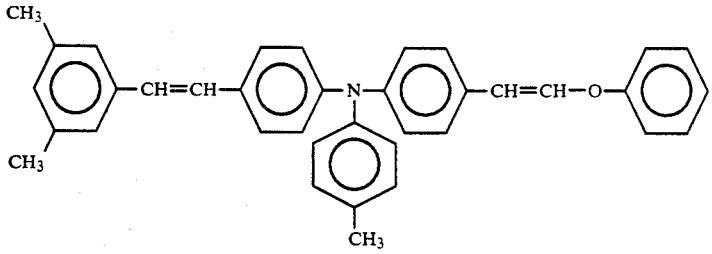
[20]
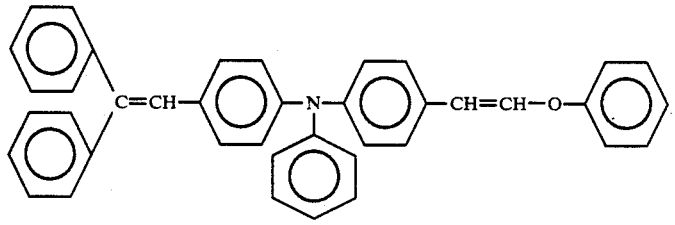
[21]
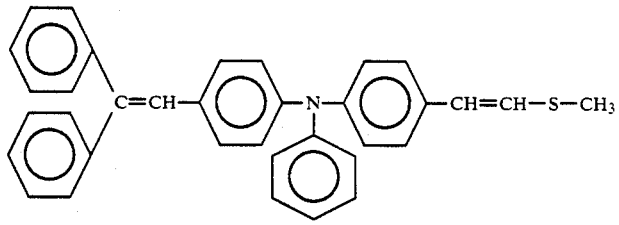
[22]
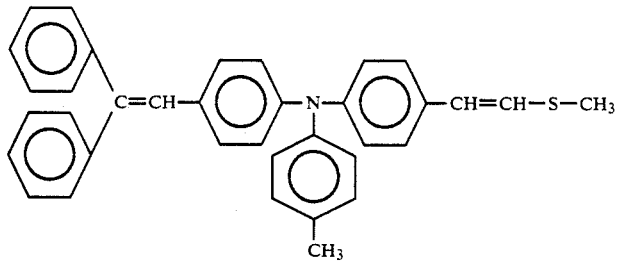
[23]
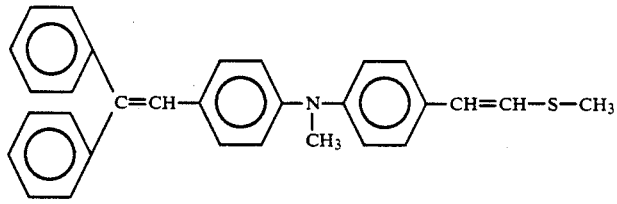
[24]
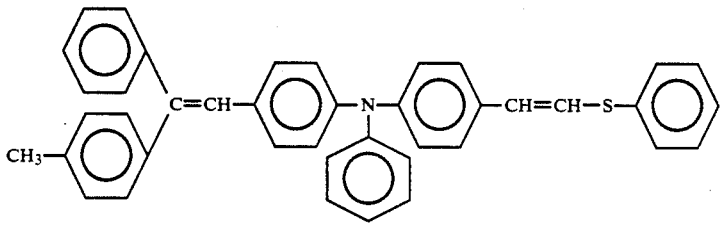

-continued
[25]
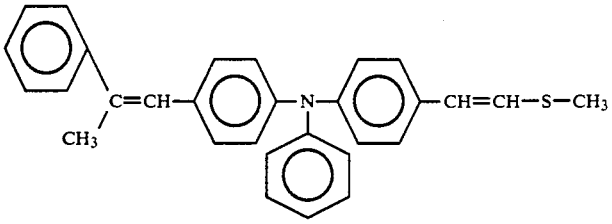
[26]
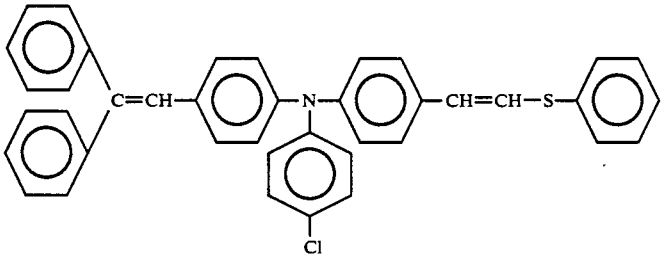
[27]
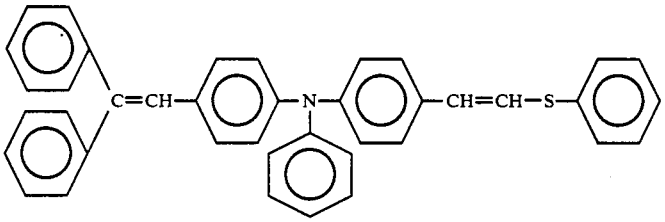
[28]
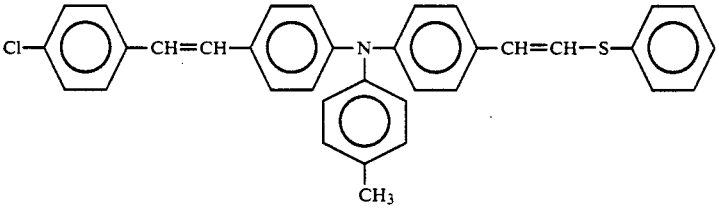
[29]
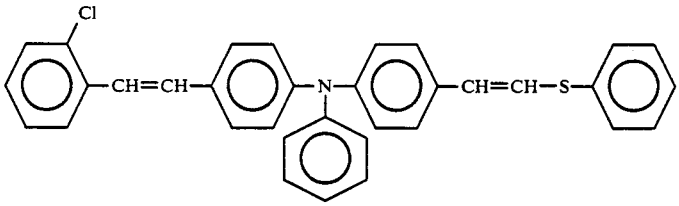
[30]
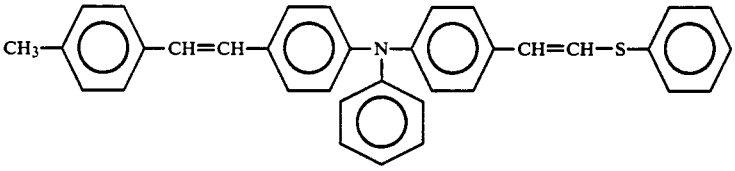
[31]
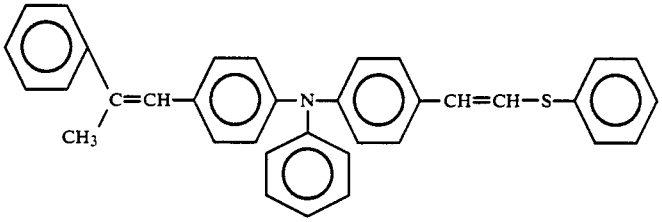

-continued
[32]
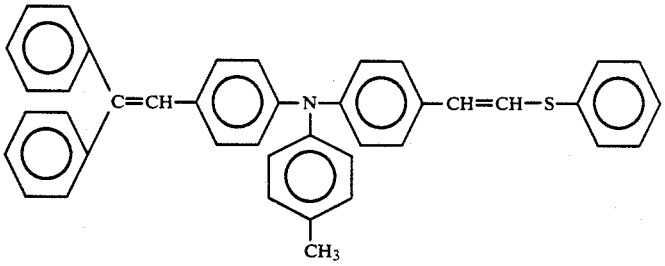
[33]
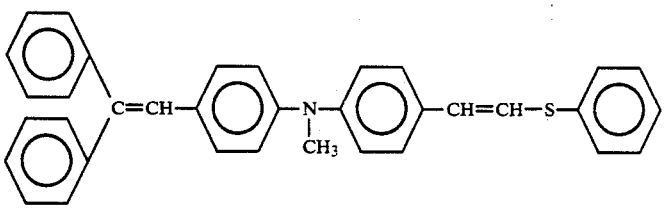
[34]
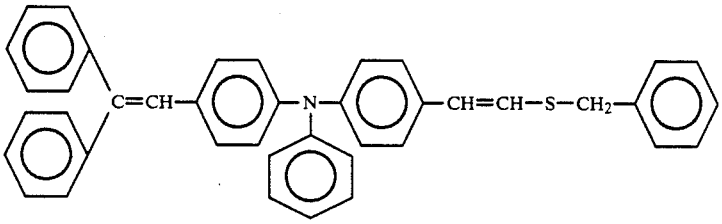
[35]
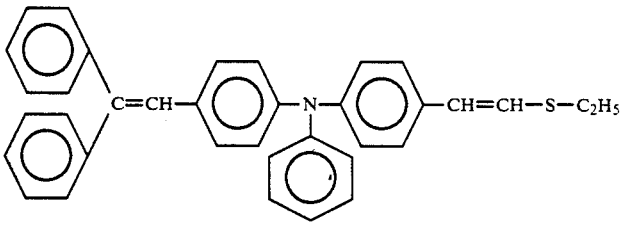
[36]
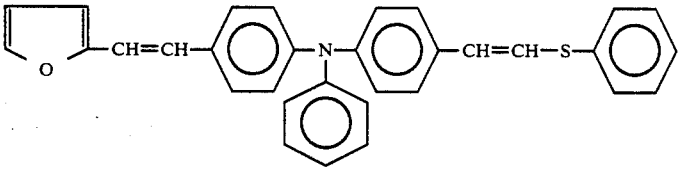
[37]
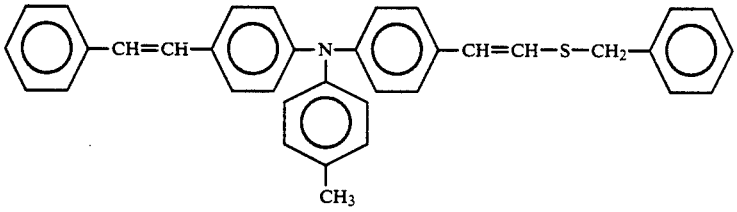
[38]
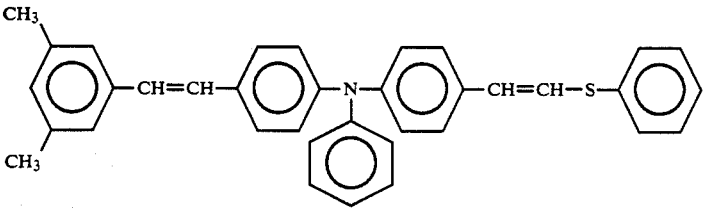

-continued

[39]

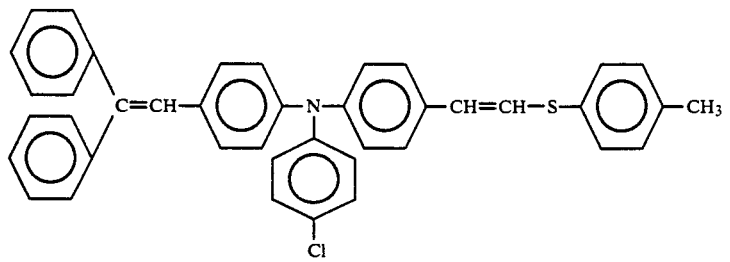

[40]

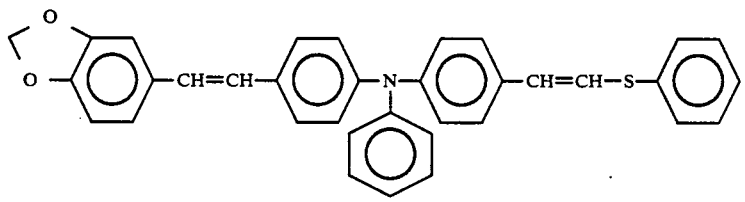

The compounds represented by the general formula [I] of the present invention may be synthesized readily by ordinary methods.

Thus, they are synthesized by the condensation of the aldehydes represented by the general formula [a]:

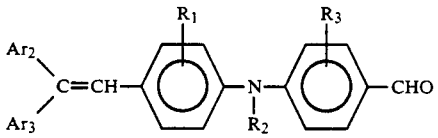

[a]

wherein $Ar_2$, $Ar_3$ and $R_1$ to $R_3$ are as same as those in the general formula [I], and phosphorus compounds represented by the general formula [b]:

$$Ar_1—X—CH—Y \quad [b]$$

wherein $Ar_1$ and X are as same as those in the general formula [I] and Y stands for trialkyl- or triarylphosphonium groups represented generally by $—P^+(R_4)_3Z^-$ or dialkyl- or diarylphosphorous acid groups shown generally by $PO(OR_5)_2$ (Z stands for a halogen atom and $R_4$ and $R_5$ for an alkyl group or an aryl group respectively).

The compounds shown by the general formula [I] may be synthesized by the condensation of the compounds shown by the general formulae [c] and [d],

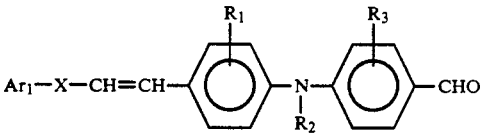

[c]

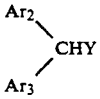

[d]

wherein $Ar_1$, $Ar_2$, $Ar_3$, $R_1$, $R_2$ and $R_3$ are as same as those in general formula [I] while Y as in the general formula [b].

The preferred solvents to be used in the reactions of the above-stated methods are hydrocarbons, alcohols and ethers, for example, methanol, ethanol, isopropanol, butanol, 2-methoxyethanol, 1,2-dimethoxyethane, bis(2-methoxyethyl)ether, dioxane, tetrahydrofuran, toluene, xylene, dimethylsulfoxide, N,N-dimethylformamide, N-methyl-pyrrolidone and 1,3-dimethyl-2-imidazolidinone may be mentioned. Among them such polar solvents as N,N-dimethyl-formamide and dimethylsulfoxide are particularly profitable.

As the condensing agents may be employed sodium hydroxide, potassium hydroxide, sodium amide, sodium hydride and such alcoholates as sodium methylate and potassium tert-butoxide.

The reaction temperature may be selected in a wide range of about 0° C. to about 100° C., but it is preferably 10° C. to about 80° C.

A second aspect of the present invention relates to photosensitive members of laminated type having a charge transporting layer and a charge generating layer on an electrically conductive substrate in which the charge transporting layer comprises at least (A) a charge-transporting material of at least one of distyryl compounds represented by the following general formula [II]:

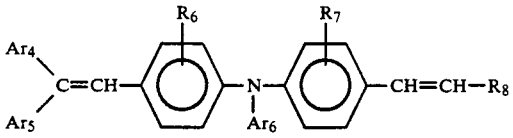

[II]

wherein $Ar_4$ and $Ar_5$ respectively stand for an alkyl group or an aryl group, each of which may have a substituent; $Ar_6$ for an alkyl group, an aralkyl group or an aryl group, each of which may have a substituent; $R_6$ and $R_7$ for a hydrogen atom, an alkyl group or an alkoxy group or a halogen atom; and $R_8$ for a hydrogen atom, an alkyl group, an alkoxy group, an aralkyl group, an alkenyl group, an alkynyl group, a thioether group or an aryl group or a heterocyclic group, the last two of which may have a substituent;

(B) a binder resin, (C) silicone oil shown by the following general formula [III] in an amount of 0.01% to 1% by weight on the basis of the charge-transporting material:

$$(R_9)—_3SiO\text{-}(R_{10})_2SiO\text{-}_nSi(R_{11})_3 \quad [III]$$

wherein $R_9$, $R_{10}$ and $R_{11}$ represent respectively an alkyl group, an aryl group, a halogen-substituted alkyl or a halogen-substituted aryl group and n represents an integer of 1 or more, and (D) t-butyrated phenol compounds as shown in the following general formula [IV] or [V] in an amount of 1% to 30% by weight on the basis of the charge-transporting material:

[IV]

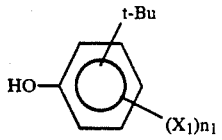

wherein $X_1$ represents a hydrogen atom, or an alkyl group, an alkoxy group which may have a substituent or a hydroxyl group and $n_1$ represents an integer of 0 to 4; when $n_1$ is more than 1, $X_1$ may be identical or different;

[V]

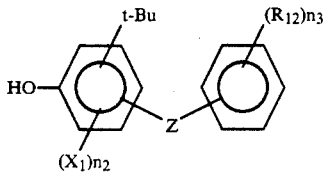

wherein $X_1$ is as same as that in the formula [IV] and $n_2$ is an integer of 0 to 3; when $n_2$ is more than 1 $X_1$, may be identical or different; Z represents —O—, —S—, —NH— or —CHR— (R is a hydrogen atom or a $C_1$ to $C_3$ alkyl group), $R_{12}$ represents a hydrogen atom, a hydroxyl group, an alkyl group, an alkoxy group or an aralkyl group and $n_3$ is an integer of 0 to 5; when $n_3$ is more than 1, $R_{12}$ may be identical or different.

When the charge-transporting material shown by the above general formula [II], silicone oil shown by the general formula [III] and the t-butyrated phenol compound represented by the general formula [IV] or [V] are used in combination with a binder resin, the stability of coating solution is improved. The formation of a charge transporting layer by such a coating solution effects the formation of a photosensitive member of laminated type with high image stability, stable repeatability, little change with time and improved resistance to oxidation by ozone and other gases. It is particularly noted that if the t-butyrated phenol compounds to be used in the second aspect of the present invention are replaced by some other compounds for combining with the other of the above ingredients, oxidation of the surface of photosensitive members by the action of ozone and the like cannot be prevented effectively.

In the general formula [II] $Ar_4$ and $Ar_5$ respectively represent methyl and other alkyl groups or phenyl and other aryl groups and these groups may be substituted by an alkyl group, an alkoxy group or a hydroxy group or by a halogen atom.

$Ar_6$ represents methyl and other alkyl groups, benzyl and other aralkyl groups or phenyl and other aryl groups, and these groups may be substituted by alkyl or alkoxy group or by halogen atom.

$R_6$ and $R_7$ respectively stand for a hydrogen atom, methyl and other alkyl groups or methoxy and other alkoxy groups or chlorine and other halogen atoms.

$R_6$ stands for a hydrogen atom, methyl, ethyl and other alkyl groups, methoxy and other alkoxy groups, benzyl and other aralkyl groups, ethenyl and other alkenyl groups, ethynyl and other alkynyl groups, phenyl, naphthyl and other aryl groups, thienyl, furyl, pyrrolyl, pyridyl and other heterocyclic groups or thiophenyl and other thioether groups.

As the distyryl compounds represented by the general formula [II], the following compounds may be shown as examples but they do not limit the scope of the present invention.

[41]

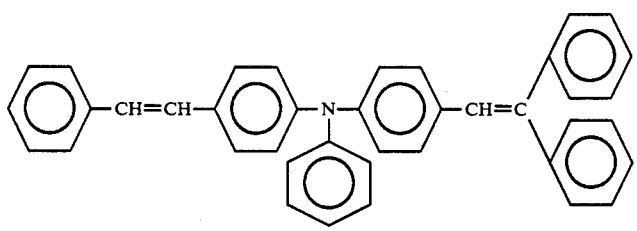

[42]

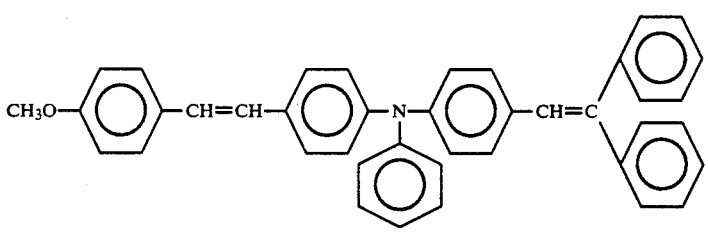

[43]

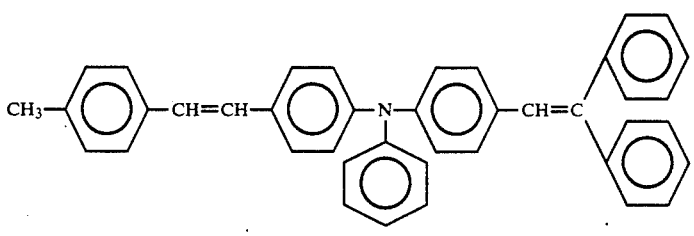

-continued
[44]
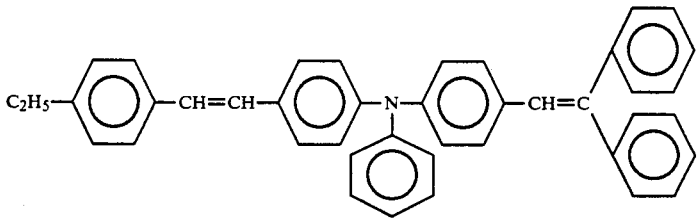
[45]
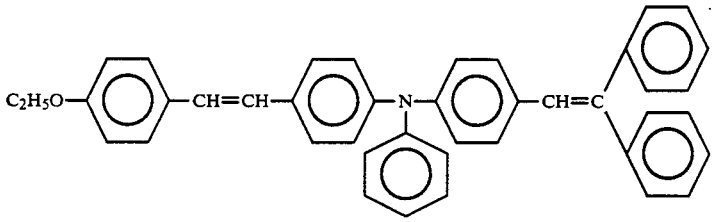
[46]
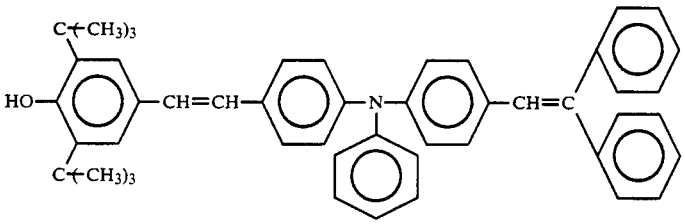
[47]
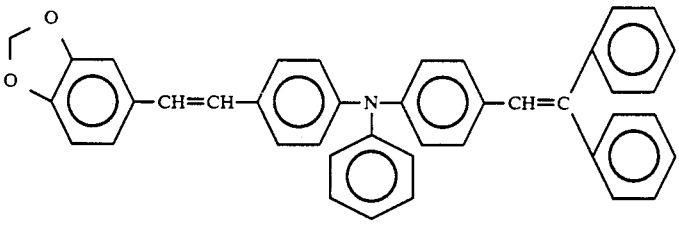
[48]
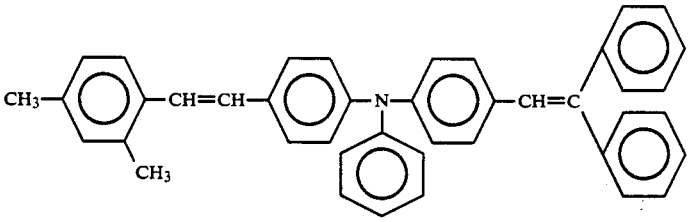
[49]
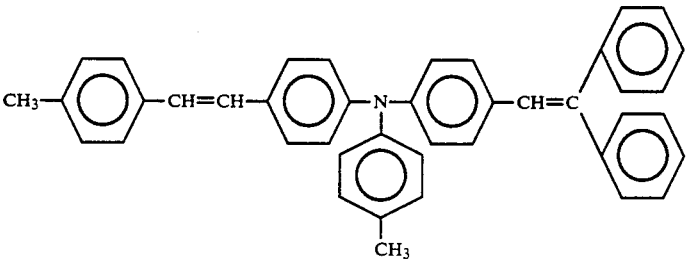

-continued
[50]
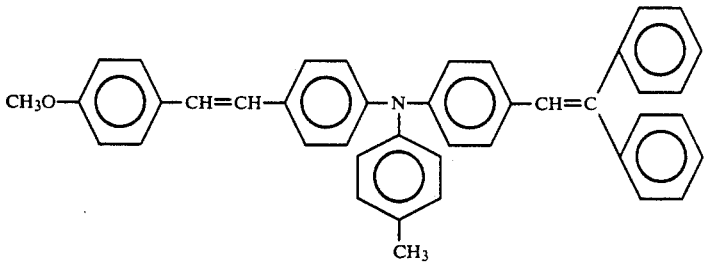
[51]
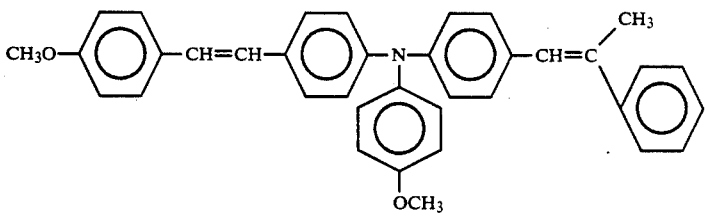
[52]
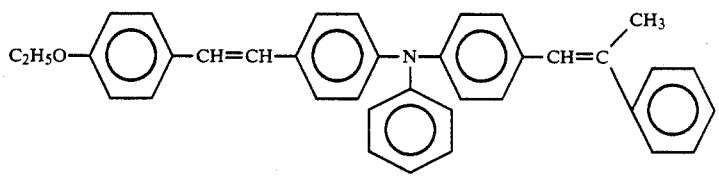
[53]
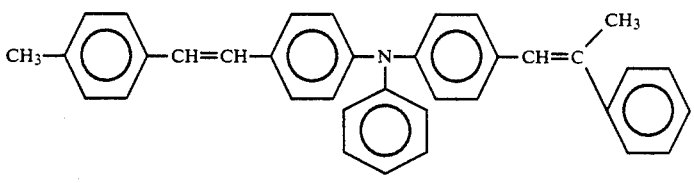
[54]
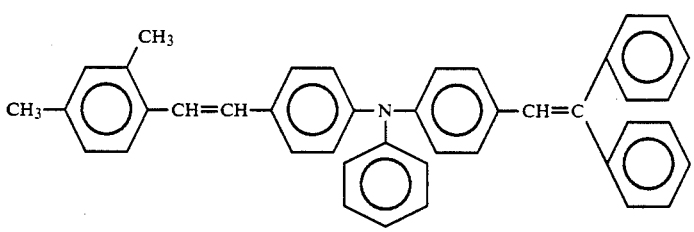
[55]
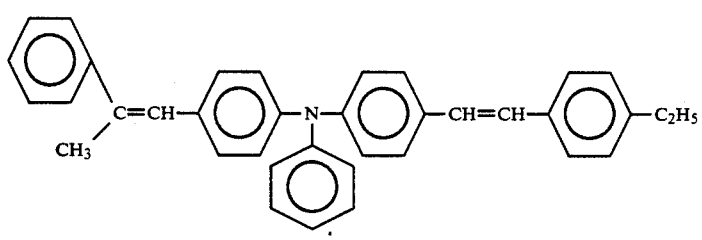
[56]
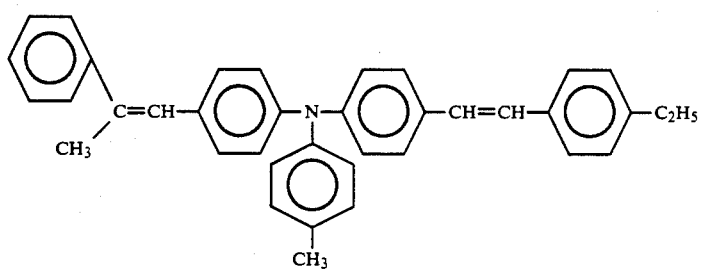

-continued
[57]
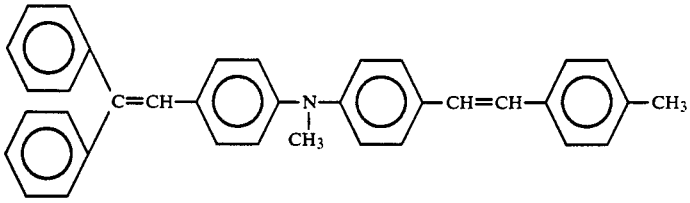
[58]
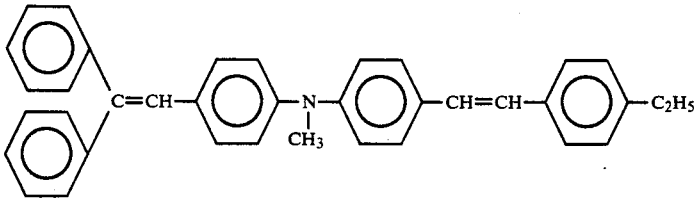
[59]
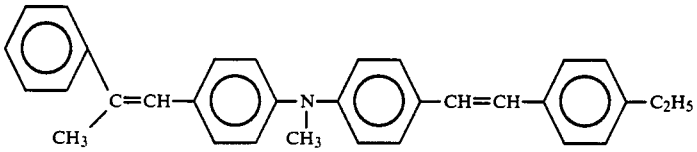
[60]
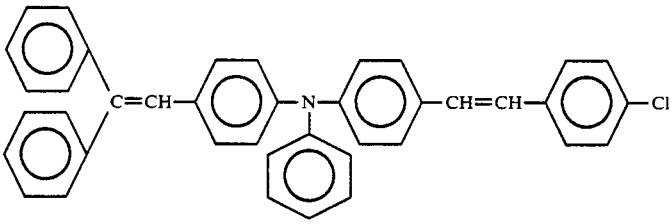
[61]
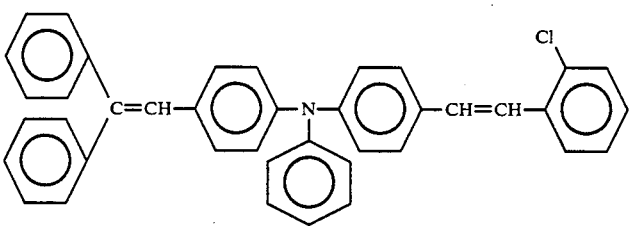
[62]
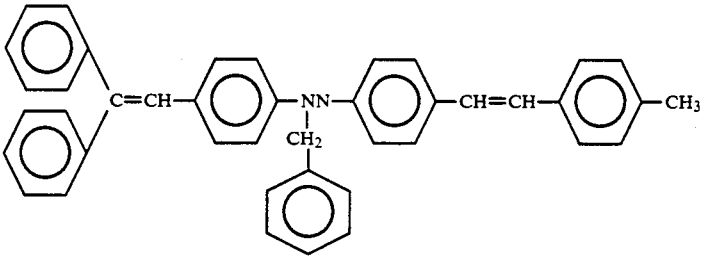
[63]
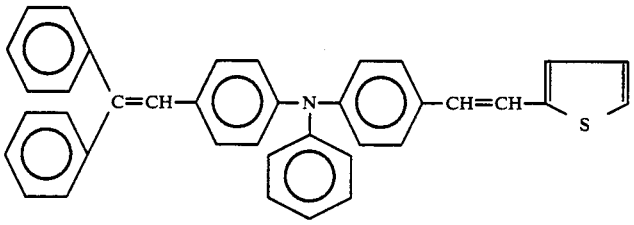

-continued
[64]
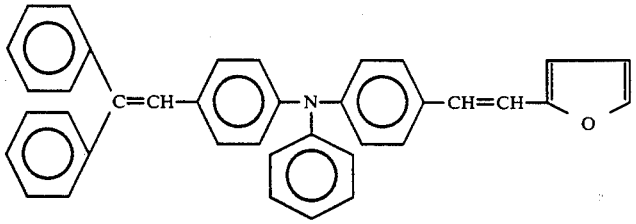
[65]
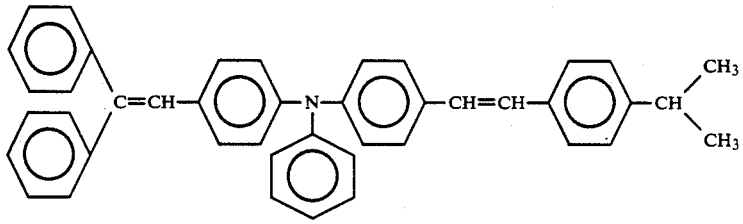
[66]
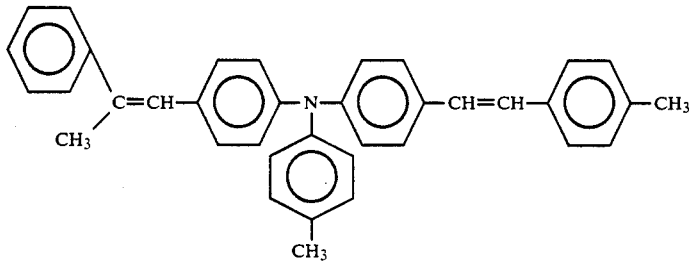
[67]
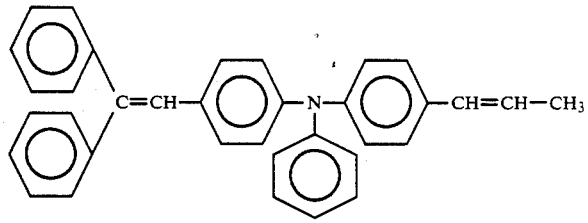
[68]
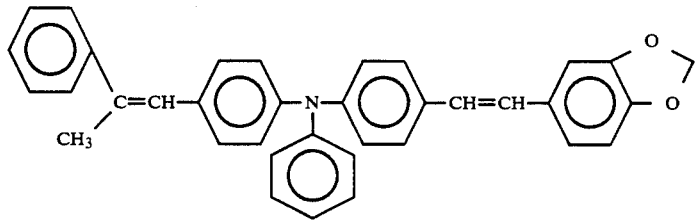
[69]
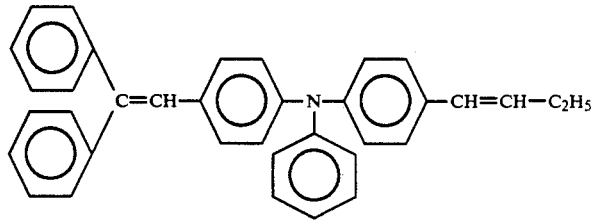

-continued
[70]
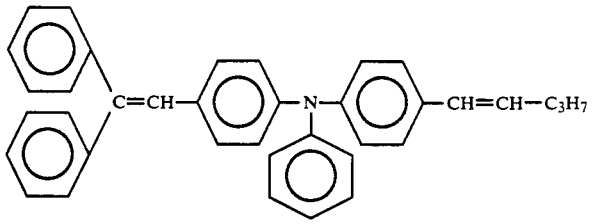
[71]
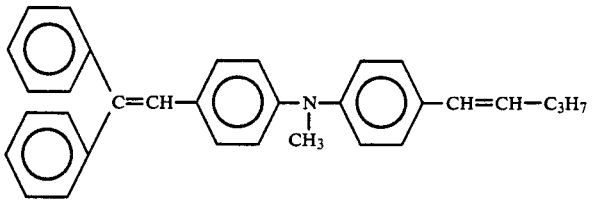
[72]
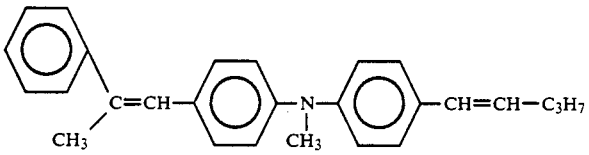
[73]
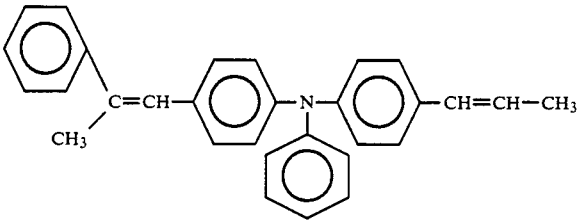
[74]
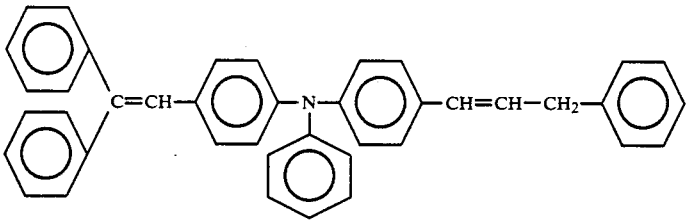
[75]
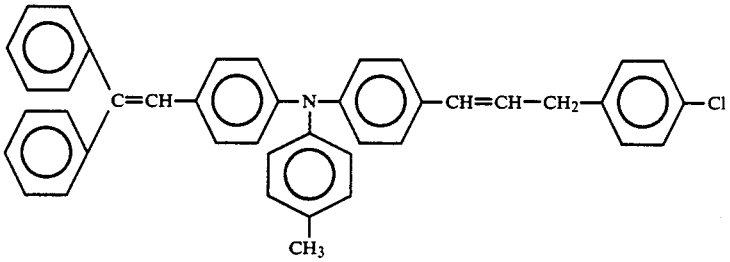
[76]
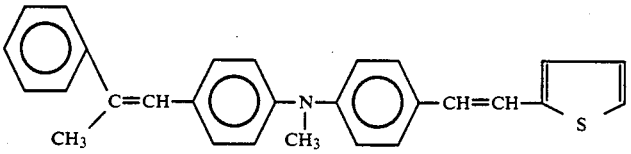

-continued

[77]

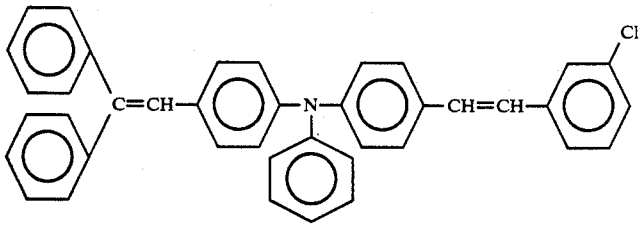

[78]

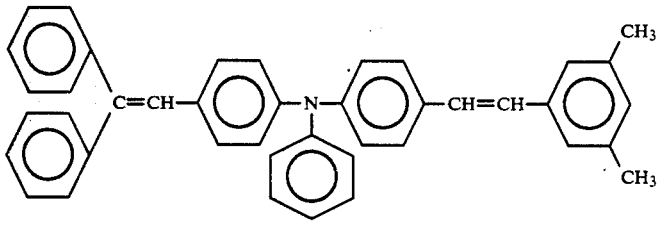

[79]

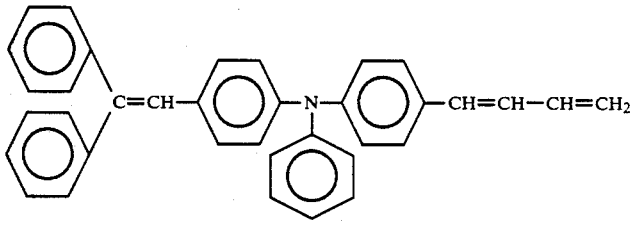

[80]

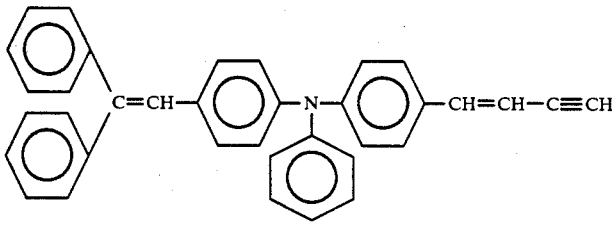

[81]

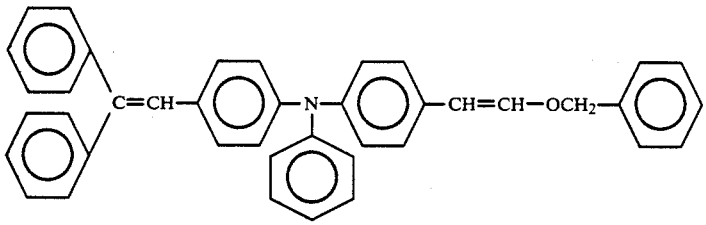

[82]

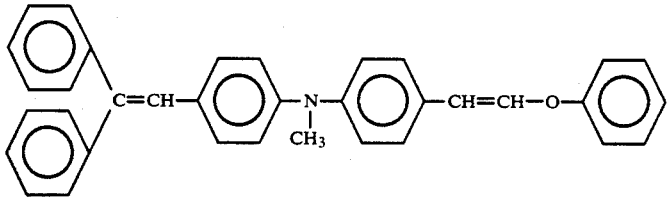

The silicone oils represented by the general formula [III]:

$$(R_9)_3SiO\text{-}(R_{10})_2SiO\text{-}_nSi(R_{11})_3 \quad [III]$$

wherein $R_9$, $R_{10}$ and $R_{11}$ respectively represent an alkyl group, an aryl group, a halogen-substituted alkyl or a halogen-substituted aryl group; n is an integer of more than 1, are exemplified by dibutyl silicone oil, phenylmethyl silicone oil, chlorophenyl silicone oil, alkyl silicone oil, fluorosilicone oil, methylstyrene-denatured silicone oil, polyether-denatured silicone oil, olefin-denatured silicone oil and methyl hydrogen silicone oil. Among them, the use of fluoro-silicone oil into which a trifluoroalkyl group is introduced is particularly effective and this introduction causes improvement in solvent resistance and abrasion resistance. It is effective to add silicone oil in an amount of 0.01% to 1% by weight on the basis of the charge-transporting material and more preferably it is 0.05% to 0.5% by weight. When it is less than 0.01% by weight, satisfactory effects cannot be obtained while when it is more than 1% by weight it may cause lowering of viscosity with the results of occurrence of run and nonuniformity at application and crystallization of the charge-transporting materials.

In the t-butyrated phenol compounds represented by the general formula [IV], $X_1$ is a hydrogen atom, a hydroxyl group, a C1–C4 alkyl group or an alkoxy group, and the C1–C4 alkyl group may contain hydroxyl, carboxyl, ester and other groups. $n_1$ is an integer of 0 to 5 and when it is more than 1, $X_1$ may be identical or different.

In the general formula [V] $X_1$ is as same as that in the above formula and $n_2$ is an integer of 0 to 3. When $n_2$ is more than 1, $X_1$ may be identical or different. Z represents —O—, —S—, —NH— or —CHR— (R is a hydrogen atom or a C1 to C3 alkyl group) and $R_{10}$ a hydrogen atom, a hydroxyl group, a C1 to C4 alkyl group, an alkoxy group or an aralkyl group such as benzyl. $n_3$ is an integer of 0 to 5 and when $n_3$ is more than 1, $R_{10}$ may be identical or different.

The amount to be added of the t-butyrated phenol compounds represented by the general formula [IV] or [V] is 1 to 30% by weight on the basis of the charge-transporting material, and preferably 5 to 25% by weight, and more preferably 10 to 20% by weight. When the amount is less than 1% by weight, the compounds are not sufficiently effective for the prevention of deterioration of photosensitive members while when it is more than 30% by weight they may cause lowered sensitivity and crystallization of the charge-transporting materials during their application.

Examples of the t-butyrated phenol compounds represented by the general formula [IV] or [V] are listed as follows:

[83]

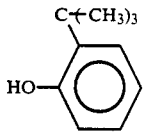

[84]

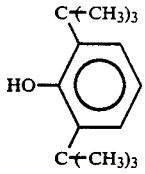

[85]

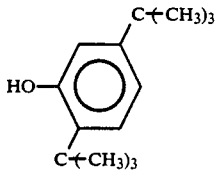

[86]

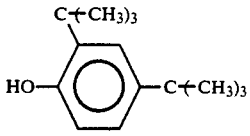

-continued

[87]

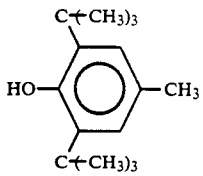

[88]

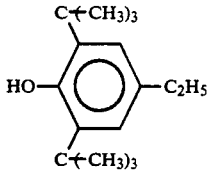

[89]

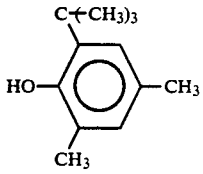

[90]

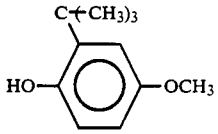

[91]

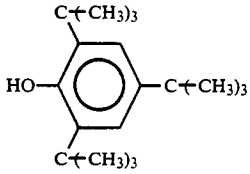

[92]

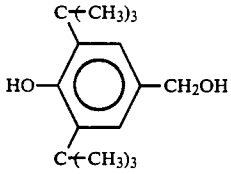

[93]

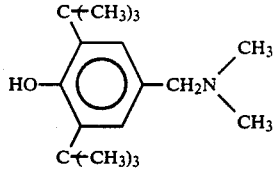

[94]

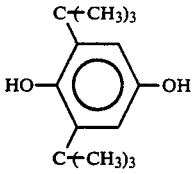

[95]

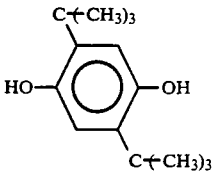

-continued

[96]

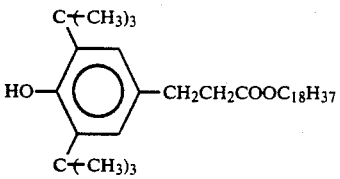

[97]

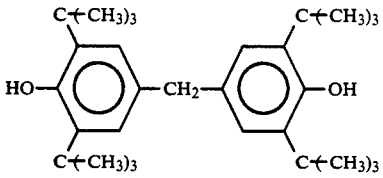

[98]

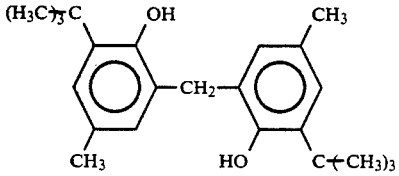

[99]

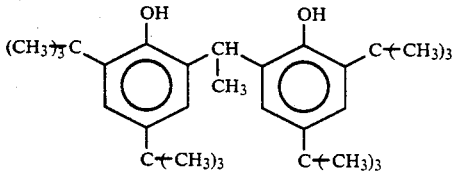

[100]

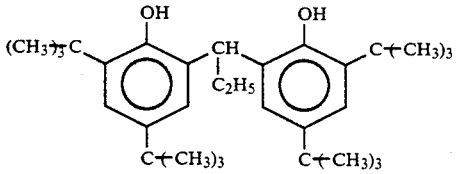

[101]

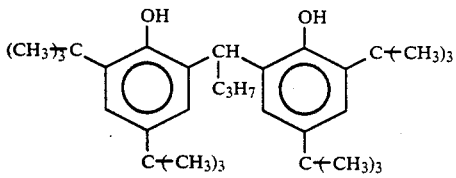

[102]

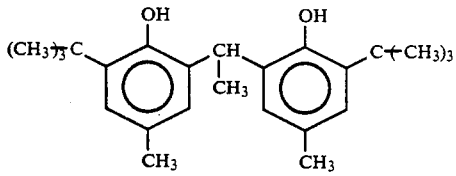

[103]

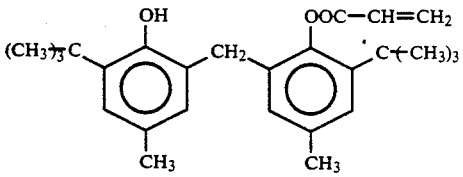

[104]

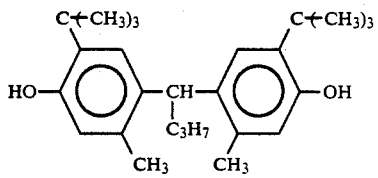

-continued

[105]

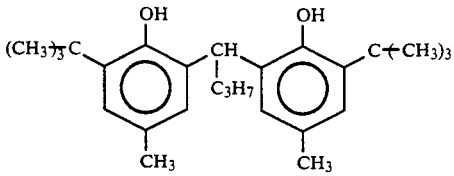

[106]

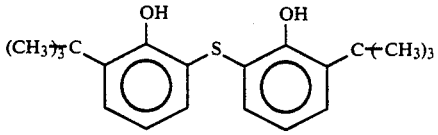

[107]

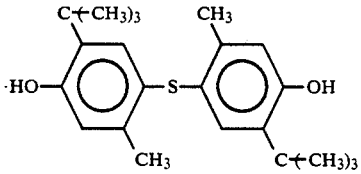

[108]

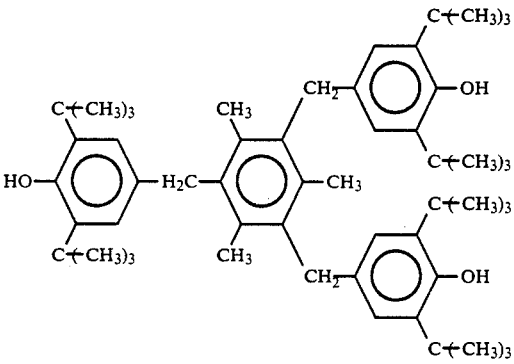

[109]

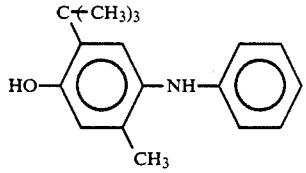

[110]

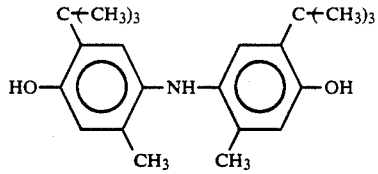

The photosensitive members of the first aspect of the present invention is composed of a photosensitive layer containing one or more of the distyryl compounds represented by the above general formula [I].

Various types of photosensitive members have been known and the photosensitive members used in the first aspect of the present invention may be any of them. For example, a monolayer photosensitive member in which a photosensitive layer containing a charge-generating material and a distyryl compound of the present invention dispersed in a binder resin is formed on or over a substrate, and a so-called photosensitive member of laminated type in which a charge-generating layer containing a charge-generating material as a major component is formed on or over a substrate and a charge-transporting layer is formed on or over the above layer, may be mentioned. The distyryl compounds are photoconductive substances but work as charge-transporting materials, and can transport very efficiently charge carriers that are generated by absorption of light.

The monolayer-type photosensitive members may be formed by dispersing fine particles of charge-generating material in a resin solution or in a solution dissolving the charge-transporting compound and the resin, and applying and drying the solution on or over the conductive substrate. The photosensitive layer is 3 to 30 μm thick and preferably 5 to 20 μm thick. Too small an amount of the charge-generating material used will cause low sensitivity and too large an amount lowered conductivity and lowered mechanical strength in the photosensitive layer, and the ratio of the material to occupy in the photosensitive layer is 0.01 to 2 parts by weight on the basis of 1 part by weight of the resin, and preferably 0.2 to 1.2 parts by weight.

For the formation of a photosensitive member of laminated type, a charge generating layer is formed by depositing a charge-generating material in vacuum on or over a conductive substrate or spraying and drying a solution containing the charge generating material and, if necessarily, a binder resin dissolved or dispersed in an appropriate solvent such as an amine. Then, a solution containing a charge-transporting material and a binder resin is sprayed on the charge generating layer and dried to form a charge transporting layer. The thickness of the charge-generating layer is preferably not larger than 4 μm, and more preferably not larger than 2 μm, and that of the charge-transporting layer 3 to 30 μm and more preferably 5 to 20 μm.

The content of a charge-transporting material in a charge-transporting layer is 0.2 to 2 parts by weight against 1 part by weight of the binder resin, and preferably 0.3 to 1.3 parts by weight.

Examples of the photosensitive members constituted by using the distyryl compounds of the first aspect of the present invention are shown schematically in FIGS. 1 to 5.

FIG. 1 shows a photosensitive member wherein a photosensitive layer (4) is formed on a substrate (1) by formulating a charge-generating material (3) and a charge-transporting material (2) to a binder resin, and the distyryl compounds of the present invention are used as a charge-transporting material.

Figure 2:
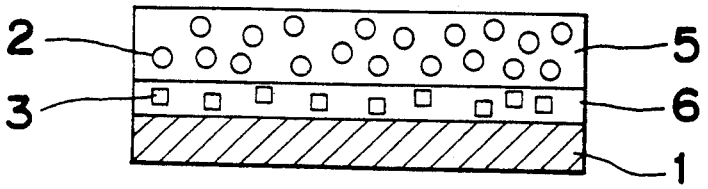
FIG. 2 shows a schematic sectional view of a separated function-type photosensitive member having a charge-generating layer (6) and a charge transporting layer (5) in this order as a photosensitive layer on a substrate.

FIG. 2 shows a separated function-type photosensitive member having a charge-generating layer (6) and a charge transporting layer (5) as a photosensitive layer, and the charge-transporting layer (5) is formed on the surface of charge-generating layer (6).

The distyryl compounds of the present invention are formulated in the charge-transporting layer (5).

Figure 3:
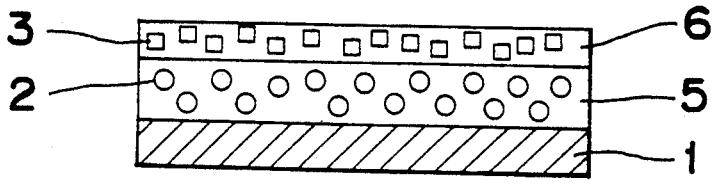
FIG. 3 shows a schematic sectional view of another separated function-type photosensitive member having a charge-transporting layer (5) and a charge-generating layer (6) in this order on a substrate.

FIG. 3 shows another separated function-type photosensitive member having, like the one in FIG. 2, the charge-generating layer (6) and the charge-transporting layer (5), but conversely to FIG. 2 the charge-generating layer is formed on the surface of the charge-transporting layer.

Figure 4:
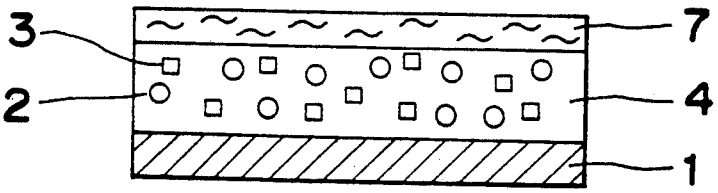
FIG. 4 shows a schematic sectional view of a photosensitive member shown in FIG. 1 with a surface-protective layer (7) formed on the photosensitive layer (4).

In a photosensitive member shown in FIG. 4, a surface-protective layer (7) is formed on the photosensitive layer in FIG. 1, and the photosensitive layer (4) may be of the separated function-type containing the charge-generating layer (6) and the charge-transporting layer (5).

The suitable materials to be used for the surface-protective layer are polymers such as acrylic resins, polyarylate resins, polycarbonate resins and urethane resins. The polymers may contain tin oxide, indium oxide or other low resistance compounds. Organic plasma polymerization layers may also be employed, and in these layers may be included oxygen, nitrogen, halogen and the atoms belonging to the groups III and V in the periodic table, if desired.

It is desirable that the surface-protective layer has a thickness of not more than 5 μm.

Figure 5:
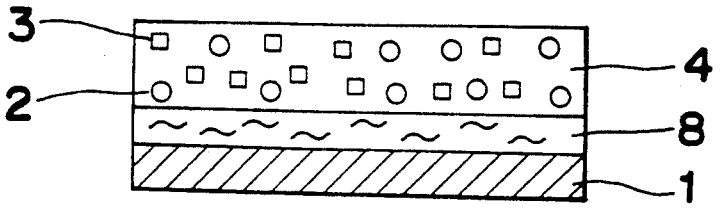
FIG. 5 shows a schematic sectional view of a photosensitive member shown in FIG. 1 with an intermediate layer (8) formed between the substrate (1) and the photosensitive layer (4).

In a photosensitive member shown in FIG. 5, an intermediate layer (8) is formed between the substrate (1) and the photosensitive layer (4). The intermediate layer (8) may be included for the sake of improvement of the adhesive property and coating efficiency, protection of the substrate and improvement of the charge flow from the substrate to the photosensitive layer.

The suitable materials to be employed here for the intermediate layer are polymers such as polyimide, polyamide, nitrocellulose, poyvinylbutyral, polyvinylalcohol. The polymers may contain tin oxide, indium oxide or other low resistance compounds. Vacuum deposited layers of aluminum oxide, zinc oxide, silicone oxide and other compounds may also be used appropriately as an intermediate layer. It is desirable to form the layer in thickness of not more than 1 μm.

Then, the cases of the formation of photosensitive members of laminated type pertinent to the present invention, by overlaying a conductive substrate with a charge-generating layer and a charge-transporting layer, by applying the charge-transporting layer of the second aspect of the present invention, are described in more detail.

For the formation of a charge-generating layer on or over a conductive substrate, charge-generating materials may be applied on or over the conductive substrate by vapor deposition or plasma polymerization, or by coating the substrate with a dispersion containing a charge-generating material dissolved or dispersed in a solution containing an appropriate resin, followed by drying. The charge-generating layer is formed so as to be 0.01 to 2 μm thick, and preferably 0.1 to 1 μm thick.

For the formation of a charge-transporting layer on or over the charge-generating layer, the above-mentioned binder resin, the material selected from the charge-transporting materials represented by the general formula [II] and the t-butyrated phenol compound shown by the general formula [IV] or [V] and the silicone oil shown by the general formula [III] are taken in combination and dissolved or dispersed in an appropriate solvent, and this coating solution is applied and dried on or over the above charge-generating layer. The charge-transporting layer is made to be 3 to 40 μm thick, and preferably 5 to 25 μm thick.

In this case, the amount of the charge-transporting material in the charge-transporting layer is made to be 0.02 to 2 parts by weight on the basis of 1 part by weight of the binder resin, and preferably 0.5 to 1.2 parts by weight.

Into the charge-transporting layer may be added further known sensitizers, thickeners, surfactants and other agents. The charge-transporting materials represented by the general formula [II] of the present invention may be used in single or in mixtures of 2 or more, or, provided that it does not spoil the effect of the present invention, other charge-transporting materials may be added.

In any of the photosensitive members obtained in the manner described above, an intermediate layer can be formed between the conductive substrate and the photosensitive layer, and a surface-protective layer on or over the surface of the photosensitive layer, if desired as described in FIG. 4 and FIG. 5.

Below are given examples of the synthesis of the distyryl compounds of the present invention.

EXAMPLE OF SYNTHESIS 1 COMPOUND [I])

An aldehyde (4.51 g) shown by the formula below:

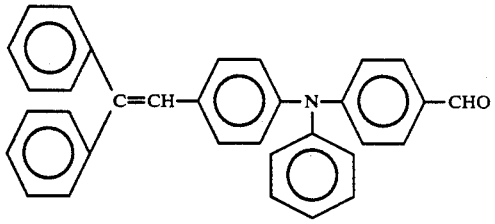

and 3.43 g (0.01 mol) of methoxymethyltriphenylphosphonium chloride were dissolved in 50 ml of dimethylformamide and to this solution was added dropwise 50 ml of dimethylformamide containing 1.68 g of potassium tert-butoxide in nitrogen atmosphere under keeping temperature at 5° C. Then the mixture was stirred at room temperature for 4 hours and allowed to react for 2 hours at 80° C. to complete the reaction.

The mixture there obtained was added into 500 ml of ice water, neutralized with hydrochloric acid and after 30 minutes crystals there separated were collected by filtration. The filtered product was washed with water, dissolved in toluene and purified by means of silica gel column chromatography. Toluene in the eluate was distilled away and the residue recrystallized from acetonitrile to obtain 3.0 g of pale yellow crystals. A peak of M+ =479 was confirmed in mass spectrum of the product.

The result of elemental analysis is as follows (for $C_{35}H_{29}NO$):

| | C (%) | H (%) | N (%) |
|---|---|---|---|
| Calculated | 87.68 | 6.05 | 2.92 |
| Found | 87.59 | 6.08 | 2.87 |

EXAMPLE OF SYNTHESIS 2 (COMPOUND [271])

Similar procedures were followed as in Example of synthesis 1 except for using 2.61 g (0.01 mol) of diethylphenylthiomethylphosphonate in place of the phosphorus compound there. The mixture obtained was added to 500 ml of water and neutralized with hydrochloric acid. After about 30 minutes, crystals there separated were collected by filtration.

The filtered product was washed with water, dissolved in toluene and purified by means of silica gel column chromatography. After the toluene in the eluate was distilled away the residue was recrystallized from ethanol to obtain 4.3 g (yield: 77.2%) of pale yellow crystals.

A peak of M+ =557 was confirmed in mass spectrum of the product.

The result of elemental analysis is as follows (for $C_{40}H_{31}NS$):

| | C (%) | H (%) | N (%) |
|---|---|---|---|
| Calculated | 86.18 | 5.57 | 2.51 |
| Found | 86.12 | 5.65 | 2.55 |

Below are given examples for more detailed explanation of the present invention, and "part(s)" in these examples signifies "part(s) by weight" unless otherwise stated.

EXAMPLE 1

The biasazo compound (0.45 parts) which is shown by the following formula [A]:

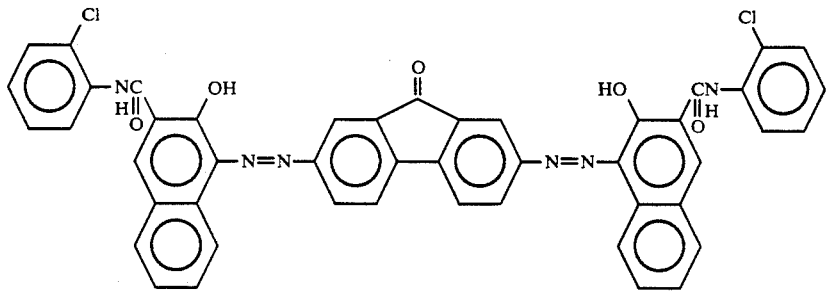

[A]

and 0.45 parts of a polyester resin (Byron 200, made by Toyo Boseki K.K.) were dispersed together with 50 parts of cyclohexanone by using a sand mill. This dispersion of the bisazo compound was applied on an aluminum Mylar, 100 μm thick, by using a film applicator so that a layer might have a thickness of 0.3 g/m² after dried. Thus, a charge generating layer was formed.

On the charge-generating layer was applied a solution made by dissolving 50 parts of the distyryl compound [1] and 50 parts of a polycarbonate resin (Panlite K-1300, made by Teijin Kasei K.K.) in 400 parts of 1,4-dioxane to obtain a charge transporting layer with a thickness of 16 μm after dried. In this way, an electrophotographic photosensitive member having a photosensitive layer comprising of 2 layers was obtained.

The photosensitive member prepared in this way was subjected to corona electrical charging at −6 KV by using an electrophotographic copying machine (EP-450Z, made by Minolta Camera K.K.), and the initial surface potential $V_0$ (v), the amount of exposure $E_{\frac{1}{2}}$ (lux.sec) required for making the initial potential half ($\frac{1}{2}$) and the dark-decreasing ratio $DDR_1$ (%) of the initial potential left for 1 second in the dark were estimated.

EXAMPLES 2 TO 4

As in Example 1, the photosensitive members of the similar constitution were prepared by the similar procedures except that in place of the distyryl compound [1] used in Example 1, the distyryl compounds [2], [3] and [4] were employed, respectively.

On these photosensitive members, $V_0$, $E_{\frac{1}{2}}$ and $DDR_1$ were estimated by the procedures used in Example 1.

EXAMPLE 5

The bisazo compound (0.45 parts) represented by the formula [B] below:

[B]

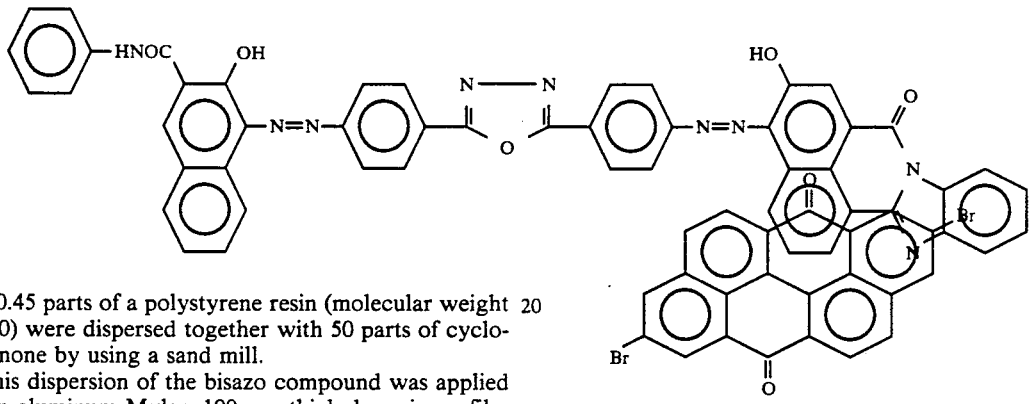

and 0.45 parts of a polystyrene resin (molecular weight 40000) were dispersed together with 50 parts of cyclohexanone by using a sand mill.

This dispersion of the bisazo compound was applied on an aluminum Mylar, 100 μm thick, by using a film applicator so that a layer might have a thickness of 0.3 g/m² after dried. Thus, a charge generating layer was formed.

On the charge-generating layer prepared in this way, a solution made by dissolving 50 parts of the distyryl compound [5] and 50 parts of a polyarylate resin (U-100, made by Yunichika K.K.) in 400 parts of 1,4-dioxane was applied to obtain a charge transporting layer with a thickness of 20 μm after dried.

An electrophotographic photosensitive member having the photosensitive layer comprising of 2 layers was prepared in this way. On this photosensitive member $V_0$, $E_{\frac{1}{2}}$ and $DDR_1$ were estimated by the procedures described in Example 1.

EXAMPLES 6 TO 8

By the similar procedures as described in Example 5, the photosensitive members of the similar constitution except that in place of the distyryl compound used in Example 5 those compounds [6], [8] and [11], respectively, were employed were prepared.

On these photosensitive members $V_0$, $E_{\frac{1}{2}}$ and $DDR_1$ were estimated by the procedures described in Example 1.

EXAMPLE 9

The polycyclic quinone-type pigment (0.45 parts) which is represented by the following formula [C]:

[C]

and 0.45 parts of a polycarbonate resin (Panlite K-1300, made by Teijin Kasei K.K.) were dispersed together with 50 parts of dichloroethane by using a sand mill.

The dispersion of the polycyclic quinone pigment thus obtained was applied on an aluminum Mylar, 100 μm thick, by using a film applicator so that a layer might have a thickness of 0.4 g/m² after dried. Thus, a charge generating layer was obtained.

Over the charge-generating layer prepared in this way was applied a solution made by dissolving 60 parts of the distyryl compound [12] and 50 parts of a polyarylate resin (U-100, made by Yunichika K.K.) in 400 parts of 1,4-dioxane to obtain a charge transporting layer of 18 μm thickness after dried.

In this way an electrophotographic photosensitive member containing a photosensitive layer which is comprised of 2 layers was prepared.

On this photosensitive member $V_0$, $E_{\frac{1}{2}}$ and $DDR_1$ were estimated by the procedures similar to Example 1.

EXAMPLES 10 TO 11

As in Example 9, the photosensitive members of similar constitution except that the distyryl compound [12] was replaced by the distyryl compounds [14] and [15], respectively, were prepared by the similar procedures.

On these photosensitive members $V_0$, $E_{\frac{1}{2}}$ and $DDR_1$ were estimated by the procedures similar to Example 1.

EXAMPLE 12

A perylene pigment (0.45 parts) represented by the formula [D]:

[D]

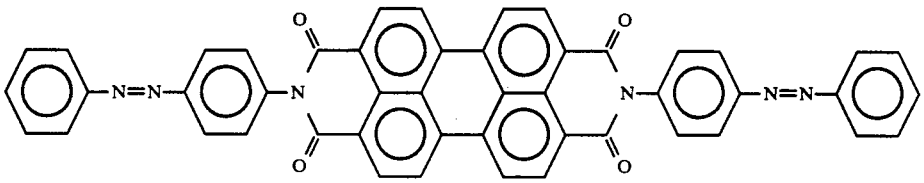

and 0.45 parts of a butyral resin (BX-1, made by Sekisui Kagaku Kogyo K.K.) were dispersed together with 50 parts of dichloroethane by using a sand mill.

The dispersion of the perylene pigment thus obtained was applied on an aluminum Mylar, 100 μm thick, by using a film applicator so that a layer might have a thickness of 0.4 g/m² after dried. Thus, a charge generating layer was formed.

Over the charge-generating layer prepared in this way was applied a solution made by dissolving 50 parts of the distyryl compound [24] and 50 parts of a polycarbonate resin (PC-Z, made by Mitsubishi Gas Kagaku K.K.) in 400 parts of 1,4-dioxane to obtain a charge transporting layer with a thickness of 16 μm after dried.

In this way an electrophotographic photosensitive member having a photosensitive layer comprising of 2 layers was prepared.

On this photosensitive member $V_0$, $E_{\frac{1}{2}}$ and DDR were estimated by the procedures similar to Example 1.

EXAMPLES 13 TO 14

By the procedures similar to Example 12, the photosensitive members of the similar constitution except that the distyryl compound [24] used in Example 12 was replaced by the distyryl compounds [26] and [27] were prepared.

On these photosensitive members $V_0$, $E_{\frac{1}{2}}$ and $DDR_1$ were estimated by the procedures similar to Example 1.

EXAMPLE 15

Titanyl phthalocyanine (0.45 parts) and 0.45 parts of a butyral resin (BX-1, made by Sekisui Kagaku Kogyo K.K.) were dispersed together with 50 parts of dichloroethane by using a sand mill.

The dispersion of the phthalocyanine pigment was applied on an aluminum Mylar, 100 μm thick, by using a film applicator so that a layer might have a thickness of 0.3 g/m² after dried. Thus, a charge generating layer was formed.

On the charge-generating layer obtained in this way was applied a solution made by dissolving 50 parts of the distyryl compound [28] and 50 parts of a polycarbonate resin (PC-Z, made by Mitsubishi Gas Kagaku K.K.) in 400 parts of 1,4-dioxane to obtain a charge transporting layer with a thickness of 18 μm after dried. In this way an electrophotographic photosensitive member having a photosensitive layer comprising of 2 layers was prepared.

On this photosensitive member $V_0$, $E_{\frac{1}{2}}$ and $DDR_1$ were estimated by the procedures similar to Example 1.

EXAMPLES 16 TO 17

By the procedures similar to those in Example 15 were prepared photosensitive members of the similar constitution except that the distyryl compound [28] used in Example 15 was replaced by the distyryl compounds [29]and [30], respectively.

On the photosensitive members thus obtained $V_0$, $E_{\frac{1}{2}}$ and $DDR_1$ were estimated by the procedures identical as in Example 1.

EXAMPLE 18

Fifty parts of copper phthalocyanine and 0.2 parts of tetranitro-copper phthalocyanine were dissolved in 500 parts of 98%-concentrated sulfuric acid with extensive stirring, and the solution was poured into 5000 parts of water to make the photoconductive composition of copper phthalocyanine and tetranitro-copper phthalocyanine separate, and then it was collected by filtration, washed with water and dried at 120° C. under reduced pressure.

Ten parts of the photoconductive composition obtained in this way were dispersed together with 22.5 parts of a thermosetting acrylic resin (Acrydick 405, made by Dai-Nippon Ink K.K.), 7.5 parts of a melamine resin (Super-Beckamine J820, made by Dai-Nippon Ink K.K.), 15 parts of the above-described distyryl compound [31] and 100 parts of a 1:1 mixed solvent of methylethylketone and xylene in a ball mill pot for 48 hours to prepare a photosensitive coating solution and this was applied on an aluminum substrate and dried to make a photosensitive layer about 15 μm thick for the formation of a photosensitive member.

On this photosensitive member $V_0$, $E_{\frac{1}{2}}$ and $DDR_1$ were estimated by the procedures similar to those in Example 1 except that corona electrical charging was carried at +6 KV instead of −6 Kv.

EXAMPLES 19 TO 21

By the procedures similar to those in Example 18, photosensitive members of the similar constitution except that the distyryl compound [31] was replaced by the distyryl compounds [32], [34] and [36], respectively, were prepared.

On these photosensitive members, $V_0$, $E_{\frac{1}{2}}$ and $DDR_1$ were estimated by the procedures identical to those in Example 1.

COMPARATIVE EXAMPLES 1 TO 4

By using the compositions with similar constitution to that described in Example 18 except that in place of the distyryl compound used in Example 18 the following compounds [E], [F], [G] and [H] were employed, respectively, the photosensitive members were prepared by the procedures similar to Example 15.

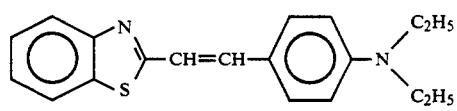

[E]

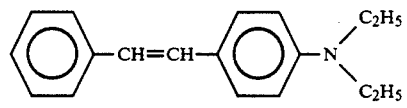

[F]

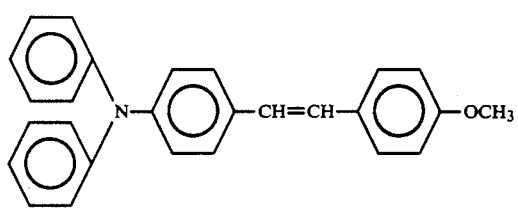

[G]

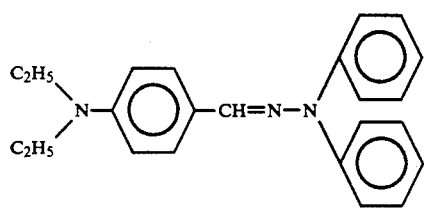

[H]

On these photosensitive members $V_0$, $E_{\frac{1}{2}}$ and $DDR_1$ were estimated by the procedures similar to Example 1. With the compounds [E] and [G], which were difficult to be dissolved, partial crystallization took place during the preparation of the photosensitive members.

COMPARATIVE EXAMPLES 5 TO 7

By using the compositions with similar constitution to that used in Example 18 except that the distyryl compound [31] used in Example 18 was replaced by the following distyryl compounds [I], [J] and [K], respectively, the photosensitive members were prepared by the procedures similar to Example 18.

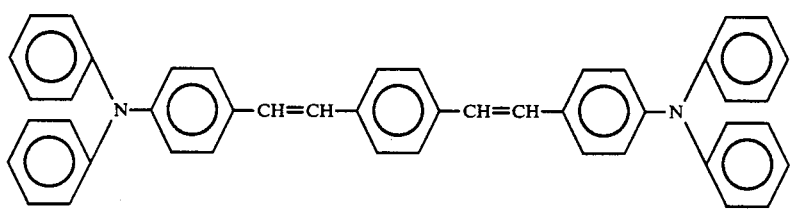

[I]

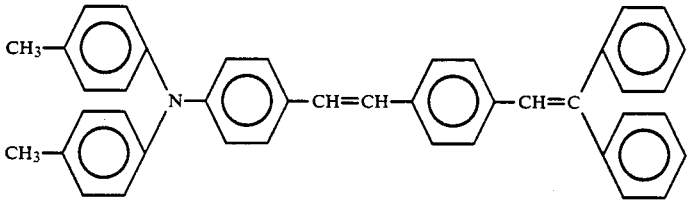

[J]

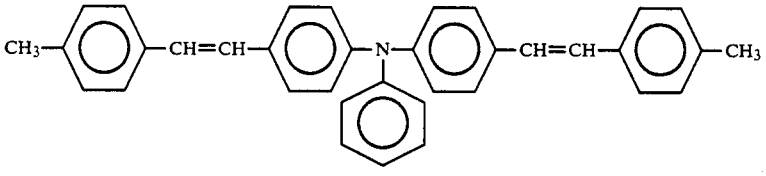

[K]

On the photosensitive members thus prepared, $V_0$, $E_{\frac{1}{2}}$ and $DDR_1$ were estimated by the procedures identical as in Example 15. The compounds [I] and [K] were difficult to be dissolved, and partially crystallized out during the preparation of the photosensitive members.

The results of estimation of $V_0$, $E_{\frac{1}{2}}$ and $DDR_1$ on the photosensitive members prepared in Examples 1 to 21 and in Comparative Examples 1 to 7 are summarized in Tables 1 and 2.

TABLE 1

| | $V_0$ (v) | $E_{\frac{1}{2}}$ (lux · sec) | $DDR_1$ (%) |
|---|---|---|---|
| Example 1 | −660 | 0.8 | 2.8 |
| Example 2 | −640 | 0.6 | 3.5 |
| Example 3 | −650 | 1.2 | 3.0 |
| Example 4 | −660 | 0.8 | 2.7 |
| Example 5 | −660 | 0.7 | 2.9 |
| Example 6 | −650 | 1.2 | 3.1 |
| Example 7 | −650 | 1.0 | 3.3 |
| Example 8 | −660 | 0.7 | 3.0 |
| Example 9 | −650 | 0.8 | 3.2 |
| Example 10 | −640 | 1.0 | 3.6 |

TABLE 1-continued

| | $V_0$ (v) | $E_{\frac{1}{2}}$ (lux · sec) | $DDR_1$ (%) |
|---|---|---|---|
| Example 11 | −660 | 0.8 | 2.8 |
| Example 12 | −650 | 1.0 | 3.0 |
| Example 13 | −650 | 1.2 | 3.1 |
| Example 14 | −650 | 0.8 | 2.9 |
| Example 15 | −650 | 0.9 | 3.1 |
| Example 16 | −640 | 0.8 | 3.6 |
| Example 17 | −650 | 0.7 | 2.9 |
| Example 18 | +610 | 0.7 | 11.5 |
| Example 19 | +610 | 0.9 | 12.0 |
| Example 20 | +600 | 0.8 | 13.0 |
| Example 21 | +610 | 1.0 | 10.8 |
| Comparative Example 1 | +620 | 15.0 | 12.0 |
| Comparative Example 2 | +610 | 10.2 | 11.5 |
| Comparative Example 3 | +600 | 6.5 | 13.7 |
| Comparative Example 4 | +600 | 3.2 | 14.3 |
| Comparative Example 5 | +620 | 13.4 | 9.8 |
| Comparative Example 6 | +600 | 3.5 | 13.0 |
| Comparative Example 7 | +610 | 3.0 | 12.4 |

EXAMPLE 22

An aluminum drum, 80 mm in outer diameter and 350 mm long, was used as a conductive substrate. The bisazo pigment (0.45 parts) with the following structure:

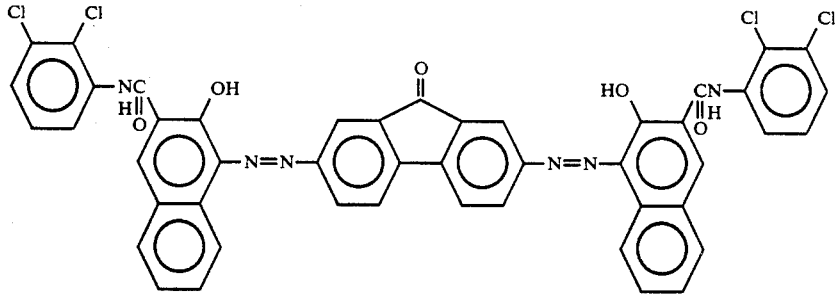

and 0.45 parts of a polyester resin (Byron 200, made by Toyo Boseki K.K.) were dispersed together with 50 parts of cyclohexanone by using a sand mill. The dispersion of the bisazo compound thus obtained was applied on the aluminum drum so that a layer might have a thickness of 0.3 g/m$^2$ after dried. Thus, a charge generating layer was formed.

On the charge-generating layer obtained in this way was applied a solution made by dissolving 50 parts of the distyryl compound [41], 50 parts of a polycarbonate resin (Panlite K-1300, made by Teijin Kasei K.K.), 5 parts of the butyrated phenol compound [88] and 0.05 parts of fluorosilicone oil (X-22-819, made by Shinetsu Kagaku K.K.) in 400 parts of 1,4-dioxane to obtain a charge transporting layer with a thickness of 20 μm after dried. In this way an electrophotographic photosensitive member having a photosensitive layer comprising of 2 layers was obtained.

EXAMPLES 23 TO 26

The photosensitive members were prepared by the procedures similar to those in Example 22 except for using tert-butyrated phenol [88] to be added to the charge-transporting layer in amounts of 2.5, 7.5, 10 and parts, respectively.

EXAMPLE 27

The bisazo pigment (0.45 parts) with the following structure:

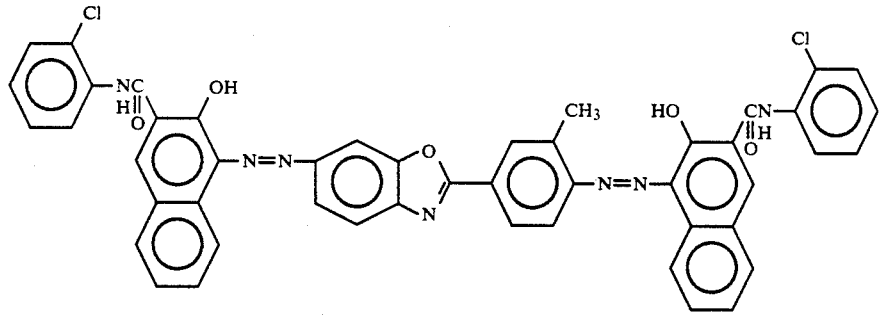

and 0.45 parts of a polystyrene resin (molecular weight 40,000) were dispersed together with 50 parts of 1,1,2-tri-chloroethane by using a sand mill.

The dispersion of the bisazo pigment thus obtained was applied on the aluminum drum so that a layer might have a thickness of 0.3 g/m$^2$ after dried. Thus, a charge generating layer was formed.

On the charge generating layer obtained in this way was applied a solution made by dissolving 45 parts of the distyryl compound [43], 50 parts of a polycarbonate resin (NOVAREX 7030, made by Mitsubishi Kasei K.K.), 7.5 parts of the tert-butyrated phenol compound [91] and 0.1 part of a fluorosilicone oil (FL-100, made by Shinetsu Kagaku K.K.) in 400 parts of tetrahydrofuran to obtain a charge transporting layer with a thickness of 20 μm after dried. In this way, an electrophotographic photosensitive member having a photosensitive layer comprising of 2 layers was obtained.

EXAMPLES 28 TO 31

Photosensitive members were prepared by the procedures similar to Example 27 except that the distyryl compound, tert-butyrated phenol compound and silicone oil were replaced by the respective substances shown in the following table.

TABLE 2

| | Distyryl compound | t-butyrated phenol compound | Amount of silicone oil added |
|---|---|---|---|
| Example 28 | [45] | [92] 2.5 parts | 0.02 parts |
| Example 29 | [48] | [87] 10 parts | 0.05 parts |
| Example 30 | [52] | [93] 12.5 parts | 0.1 part |
| Example 31 | [54] | [97] 7.5 parts | 0.2 parts |

EXAMPLE 32

τ-Non-metal phthalocyanine (0.45 parts) and 0.45 parts of a butyral resin (BX-1, made by Sekisui Kagaku Kogyo K.K.) were dispersed together with 50 parts of dichloroethane by using a sand mill. The dispersion of the phthalocyanine pigment thus obtained was applied on the aluminum drum so that a layer might have a thickness of 0.2 g/m$^2$ after dried. Thus, a charge generating layer was formed.

On the charge generating layer was applied a solution made by dissolving 50 parts of the distyryl compound [55], 50 parts of a polycarbonate resin (PC-Z, made by Mitsubishi Gas Kagaku K.K.), 10 parts of the tert-butyrated phenol compound [103] and 0.03 parts of dimethylsilicone oil (KF-69, made by Shinetsu Kagaku K.K.) in 400 parts of tetrahydrofuran to obtain a charge transporting layer with a thickness of 20 μm after dried. In this way, an electrophotographic photosensitive member having a photosensitive layer comprising of 2 layers.

EXAMPLES 33 TO 37

The photosensitive members were prepared by the procedures similar to Example 32 except for replacing the distyryl compound, tert-butyrated phenol compound and silicone oil to be used for the preparation of the charge-transporting layer by the substances shown in the following table.

TABLE 3

| | Distyryl compound | t-Butyrated phenol compound | Silicone oil Oil (by Shinetsu Kagaku) | Amount added (parts) |
|---|---|---|---|---|
| Example 33 | [57] | [98] | Methylhydrogen silicone oil (KF99) | 0.05 |
| Example 34 | [60] | [99] | α-Phenylsilicone oil (KF54) | 0.1 |
| Example 35 | [64] | [101] | α-Methylstyrene-denatured silicone oil (KF410) | 0.05 |
| Example 36 | [68] | [104] | α-Olefin-denatured silicone oil (KF413) | 0.1 |
| Example 37 | [75] | [106] | Polyether-denatured silicone oil (KF995) | 0.2 |

COMPARATIVE EXAMPLES 8 TO 10

Photosensitive members were prepared by the procedures similar to Example 22 except for changing the amount of tert-butyrated phenol compound to be added to 0, 0.2 and 20 parts.

COMPARATIVE EXAMPLES 11 TO 12

Photosensitive members were prepared by the procedures similar to Example 22 except for changing the amount of silicone oil to be added to 0 and 0.7 parts.

COMPARATIVE EXAMPLES 13 TO 18

The photosensitive members were prepared by the procedures similar to Example 32 except for replacing tert-butyrated phenol compound [103] used therein by the compounds shown in Table 4 below.

TABLE 4

| Compounds |
|---|
| Comparative Example 13<br>N-Phenyl-β-naphthylamine |
| Comparative Example 14<br>6-Ethoxy-2,2,4-trimethyl-1,2-dihydroquinoline |
| Comparative Example 15<br>Trinonylphenyl phosphite |
| Comparative Example 16<br>2-Hydroxy-n-octoxybenzophenone |
| Comparative Example 17<br>2-(2'-Hydroxy-5'-methylphenyl)benzotriazole |
| Comparative Example 18<br>Bis-(2,2,6,6-tetramethyl-4-piperidinyl)sebacate |

The photosensitive member prepared in this way was subjected to corona electrical charging at −6 KV by using an electrophotographic copying machine (EP-470Z, made by Minolta Camera K.K.), and the initial surface potential $V_0$ (v), the amount of exposure $E_{\frac{1}{2}}$ (lux.sec) required for making the initial potential half($\frac{1}{2}$) and the dark-decreasing ratio $DDR_1$ (%) of the initial potential left for 1 second in the dark were estimated.

Then $V_0$, $E_{\frac{1}{2}}$ and $DDR_1$ were estimated after 1000 times repetition of the electrophotographic process in the state of removed developing apparatus.

Under these conditions discharging from charger and transfer charger was kept continuous.

Results are shown in Tables 5 and 6.

TABLE 5

| | Initial | | | After 1000 times of processing | | |
|---|---|---|---|---|---|---|
| | $V_0$ (v) | $E_{1/2}$ (lux · sec) | $DDr_1$ (%) | $V_0$, (V) | $E_{1/2}$, (lux · sec) | $DDR_1$, (%) |
| Example 22 | 650 | 0.8 | 3.1 | 640 | 0.7 | 3.3 |
| Example 23 | 650 | 0.8 | 3.3 | 630 | 0.7 | 3.5 |
| Example 24 | 650 | 0.8 | 2.7 | 650 | 0.8 | 3.1 |
| Example 25 | 660 | 0.9 | 2.5 | 660 | 0.9 | 2.8 |
| Example 26 | 670 | 1.1 | 2.2 | 660 | 1.0 | 2.5 |
| Example 27 | 660 | 1.0 | 2.4 | 650 | 1.0 | 2.7 |
| Example 28 | 650 | 0.9 | 2.8 | 630 | 0.9 | 3.0 |
| Example 29 | 660 | 1.0 | 2.6 | 650 | 0.9 | 2.9 |
| Example 30 | 670 | 1.1 | 2.8 | 670 | 1.0 | 3.1 |
| Example 31 | 650 | 0.9 | 3.0 | 630 | 0.9 | 3.2 |
| Example 32 | 660 | 0.8 | 2.4 | 640 | 0.7 | 2.6 |
| Example 33 | 650 | 0.8 | 2.8 | 640 | 0.8 | 3.1 |
| Example 34 | 650 | 0.8 | 2.7 | 640 | 0.8 | 2.9 |
| Example 35 | 650 | 0.7 | 2.5 | 650 | 0.8 | 2.7 |
| Example 36 | 650 | 0.9 | 2.6 | 650 | 0.9 | 3.0 |
| Example 37 | 650 | 1.0 | 2.8 | 640 | 1.0 | 3.2 |

TABLE 6

| | Initial | | | After 1000 times of processing | | |
|---|---|---|---|---|---|---|
| | $V_0$ (v) | $E_{1/2}$ (lux · sec) | $DDr_1$ (%) | $V_0$, (V) | $E_{1/2}$, (lux · sec) | $DDR_1$, (%) |
| Comparative Example 8 | 640 | 0.8 | 3.5 | 580 | 0.6 | 5.3 |
| Comparative Example 9 | 640 | 0.8 | 3.2 | 600 | 0.6 | 4.8 |
| Comparative Example 10 | 700 | 3.5 | 1.8 | 680 | 3.3 | 2.5 |
| Comparative Example 11 | 640 | 0.8 | 3.2 | 620 | 0.8 | 3.5 |
| Comparative Example 12 | 670 | 1.2 | 2.0 | 660 | 1.8 | 2.6 |
| Comparative Example 13 | 690 | 9.5 | 1.7 | 680 | 10.4 | 2.2 |
| Comparative Example 14 | 700 | 15.7 | 1.8 | 690 | 19.3 | 2.0 |
| Comparative Example 15 | 620 | 0.8 | 4.0 | 400 | 0.5 | 14.3 |
| Comparative Example 16 | 600 | 0.7 | 5.8 | 430 | 0.5 | 18.5 |
| Comparative Example 17 | 660 | 2.6 | 3.2 | 630 | 3.5 | 4.0 |
| Comparative Example 18 | 690 | 3.9 | 2.3 | 670 | 4.3 | 2.8 |

As obvious from Tables 5 and 6, these photosensitive members containing no or low concentrations of tert-butyrated phenol compounds and silicone oils in the change-transporting layer showed extensive deterioration whereas the photosensitive members of the present invention showed improved properties, revealing better characteristics when compared with the members containing other additives.

On the photosensitive members obtained in Example 22 and Comparative Examples 8, 11 and 12, the initial surface potential $V_0$(V), the potential after exposure $V_i$ (V) and the quality of the copied image were estimated and evaluated after 10,000 times of copy by using a copying machine EP-470Z, made by Minolta Camera K.K.). The results are shown in Table 7. For the quality of image, the symbol "○" signifies good, the symbol "Δ" bearing some problems and the symbol "×" bearing great problems.

TABLE 7

| | Initial | | | After 10,000 times of copy | | |
|---|---|---|---|---|---|---|
| | $V_0$ (V) | $V_i$ (V) | Image quality | $V_0$ (V) | $V_i$ (V) | Image quality |
| Example 22 | 650 | 100 | ○ | 640 | 95 | ○ |
| Comparative Example 8 | 640 | 100 | ○ | 590 | 80 | × Lowered density Defect in fine lines |
| Comparative Example 11 | 660 | 110 | ○ | 620 | 90 | Δ Lowered density |
| Comparative Example 12 | 670 | 130 | Δ Non-uniformity in coating | 680 | 180 | × Fogging |

The photosensitive members obtained in Example 22 produced satisfactory characteristics of copied image whereas those obtained in the Comparative examples gave lowered density of image, lowered reproducibility of fine lines, occurrence of fogs and other deteriorations in copied image. The coating solution prepared in Example 22 was in good conditions after left for 6 months while those obtained in the Comparative Examples became viscous and slightly deeper in yellow color.

What is claimed is:

1. A photosensitive member having a photosensitive layer on or over an electrically conductive substrate, comprising a distyryl compound represented by the general formula [I] below:

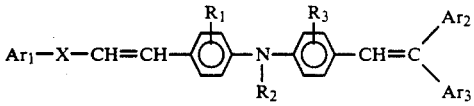

[I]

in which $Ar_1$ represents an alkyl group, an aralkyl group or an aryl group, each of which may have a substituent; $Ar_2$ and $Ar_3$ represent respectively a hydrogen atom, an alkyl group, an aralkyl group, an aryl group or heterocyclic group each of which may have a substituent except for the hydrogen atom; $R_1$ and $R_3$ represent respectively a hydrogen atom, an alkyl group or an alkoxy group or a halogen atom; $R_2$ represents an alkyl group, an aralkyl group or an aryl group each of which may have a substituent; and X represents an oxygen atom or a sulfur atom.

2. A photosensitive member as claimed in claim 1, wherein the photosensitive layer comprises a charge-generating material and a charge-transporting material.

3. A photosensitive member as claimed in claim 1, wherein the photosensitive layer is 3 to 30 μm thick.

4. A photosensitive member as claimed in claim 3, wherein the amount of the charge-generating material contained in the photosensitive layer is 0.01 to 2 parts by weight on the basis of 1 part by weight of a resin.

5. A photosensitive member as claimed in claim 1, wherein the photosensitive layer comprises a charge-generating layer and a charge-transporting layer.

6. A photosensitive member as claimed in claim 5, wherein the charge-generating layer is 4 μm thick or less.

7. A photosensitive member as claimed in claim 5, wherein the charge-transporting layer is 3 to 30 μm thick.

8. A photosensitive member as claimed in claim 4, wherein the amount of the distyryl compound contained in the charge-transporting layer is 0.2 to 2 parts by weight on the basis of 1 part by weight of the binder resin.

9. A photosensitive members of laminated type having a charge transporting layer and a charge generating layer on an electrically conductive substrate in which the charge transporting layer comprises at least (A) a charge-transporting material of at least one of distyryl compounds represented by the following general formula [II]:

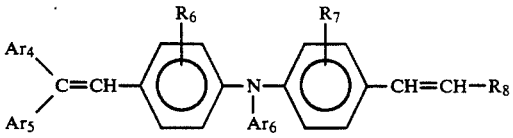

[II]

wherein $Ar_4$ and $Ar_5$ respectively represent an alkyl group or an aryl group, each of which may have a substituent; $Ar_6$ represents an alkyl group, an aralkyl group or an aryl group, each of which may have a substituent; $R_6$ and $R_7$ represent respectively a hydrogen atom, an alkyl group or an alkoxy group or a halogen atom; and $R_8$ represents a hydrogen atom, an alkyl group, an alkoxy group, an aralkyl group, an alkenyl group, an alkynyl group, a thioether group or an aryl group or a heterocyclic group, the last two of which may have a substituent;

(B) a binder resin, (C) silicone oil shown by the following general formula [III] in an amount of 0.01% to 1% by weight on the basis of the charge-transporting material:

$$(R_9)-{}_3SiO\text{-}(R_{10})_2SiO\text{-}_nSi(R_{11})_3 \quad [III]$$

wherein $R_9$, $R_{10}$ and $R_{11}$ represent respectively an alkyl group, an aryl group, a halogen-substituted alkyl or a halogen-substituted aryl group and n represents an integer of 1 or more, and (D) t-butyrated phenol compounds represented by the following general formula [IV] or [V] in an amount of 1% to 30% by weight on the basis of the charge-transporting material:

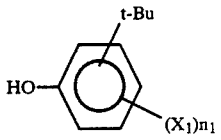

[IV]

wherein $X_1$ represents a hydrogen atom, or an alkyl group, an alkoxy group which may have a substituent or a hydroxyl group and $n_1$ represents an integer of 0 to 4; when $n_1$ is more than 1, $X_1$ may be identical or different;

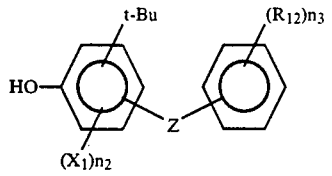

[V]

wherein $X_1$ is as same as that in the formula [IV] and $n_2$ is an integer of 0 to 3; when $n_2$ is more than 1, $X_1$, may be identical or different; Z represents —O—, —S—, —NH— or —CHR— (R is a hydrogen atom or a $C_1$ to $C_3$ alkyl group), $R_{12}$ represents a hydrogen atom, a hydroxyl group, an alkyl group, an alkoxy group or an aralkyl group and $n_3$ is an integer of 0 to 5; when $n_3$ is more than 1, $R_{12}$ may be identical or different.

10. A photosensitive member as claimed in claim 9, wherein the charge-generating layer is 0.01 to 2 μm thick.

11. A photosensitive member as claimed in claim 10, wherein the charge-generating layer is formed by dispersing a charge-generating material into a resin.

12. A photosensitive member as claimed in claim 9, wherein the charge-transporting layer is 3 to 40 μm thick.

13. A photosensitive member as claimed in claim 12, wherein an amount of the distyryl compound contained in the charge transporting layer is 0.02 to 2 parts by weight on the basis of 1 part by weight of a binder resin.

14. A photosensitive member as claimed in claim 9, wherein an amount of the silicone oil contained in the charge-transporting layer is 0.01 to 1% by weight on the basis of the charge-transporting material.

15. A photosensitive member as claimed in claim 9, wherein an amount of the t-butyrated phenol compound contained in the charge-transporting layer is 1 to 30% by weight on the basis of the charge-transporting material.

16. A photosensitive member as claimed in claim 9, further comprising a surface-protective layer.

* * * * *